US008535863B2

(12) United States Patent
Asano et al.

(10) Patent No.: US 8,535,863 B2
(45) Date of Patent: Sep. 17, 2013

(54) ELECTROPHOTOGRAPHIC PHOTORECEPTOR, AND IMAGE FORMING APPARATUS AND PROCESS CARTRIDGE USING SAME

(75) Inventors: Tomoharu Asano, Shizuoka (JP); Hiroshi Ikuno, Kanagawa (JP); Yasuhito Kuboshima, Shizuoka (JP); Yuuji Tanaka, Shizuoka (JP)

(73) Assignee: Ricoh Company, Ltd., Tokyo (JP)

( * ) Notice: Subject to any disclaimer, the term of this patent is extended or adjusted under 35 U.S.C. 154(b) by 139 days.

(21) Appl. No.: 13/207,589

(22) Filed: Aug. 11, 2011

(65) Prior Publication Data

US 2012/0052424 A1 Mar. 1, 2012

(30) Foreign Application Priority Data

Aug. 25, 2010 (JP) ..... 2010-187830
Jun. 27, 2011 (JP) ..... 2011-141381

(51) Int. Cl.
*G03G 15/04* (2006.01)

(52) U.S. Cl.
USPC ..... 430/66; 430/56

(58) Field of Classification Search
USPC ..... 430/56, 58.05, 66
See application file for complete search history.

(56) References Cited

U.S. PATENT DOCUMENTS

| | | | | |
|---|---|---|---|---|
| 5,656,406 | A | 8/1997 | Ikuno et al. | |
| 6,998,209 | B2 | 2/2006 | Ikuno et al. | |
| 7,175,957 | B2 | 2/2007 | Suzuki et al. | |
| 7,179,573 | B2 | 2/2007 | Suzuki et al. | |
| 7,189,487 | B2 | 3/2007 | Ikuno et al. | |
| 7,279,260 | B2 | 10/2007 | Nagai et al. | |
| 7,361,438 | B2 | 4/2008 | Suzuki et al. | |
| 7,381,511 | B2 | 6/2008 | Ikegami et al. | |
| 7,399,563 | B2 | 7/2008 | Suzuki et al. | |
| 7,718,333 | B2 | 5/2010 | Nagai et al. | |
| 2005/0170272 | A1* | 8/2005 | Suzuki et al. | 430/66 |
| 2005/0255393 | A1 | 11/2005 | Nakata et al. | |
| 2006/0014090 | A1 | 1/2006 | Shiino et al. | |
| 2006/0019185 | A1 | 1/2006 | Amamiya et al. | |
| 2007/0212627 | A1* | 9/2007 | Yanagawa et al. | 430/58.75 |
| 2011/0020740 | A1 | 1/2011 | Sugino et al. | |

FOREIGN PATENT DOCUMENTS

| | | |
|---|---|---|
| EP | 1734411 A1 | 3/2005 |
| JP | 9-236938 | 9/1997 |
| JP | 2003-43706 | 2/2003 |
| JP | 2006-138956 | 6/2006 |
| JP | 2007-178813 | 7/2007 |
| JP | 4095509 | 3/2008 |
| JP | 4597837 | 10/2010 |

* cited by examiner

OTHER PUBLICATIONS

Oct. 14, 2011 European search report in connection with counterpart European patent application No. 11 17 7442.

*Primary Examiner* — Mark F Huff
*Assistant Examiner* — Stewart Fraser
(74) *Attorney, Agent, or Firm* — Cooper & Dunham LLP

(57) ABSTRACT

A photoreceptor including an electroconductive substrate; a photosensitive layer located overlying the electroconductive substrate; and a crosslinked outermost layer located overlying the photosensitive layer and including a crosslinked material and a specific carbazole compound serving as a charge transport material. An image forming apparatus including the photoreceptor; a charger to charge the photoreceptor; an irradiator to irradiate the charged photoreceptor to form an electrostatic latent image thereon; a developing device to develop the electrostatic latent image with a developer including a toner to form a toner image on the photoreceptor; and a transferring device to transfer the toner image onto a recording material.

11 Claims, 4 Drawing Sheets

ELECTROPHOTOGRAPHIC PHOTORECEPTOR, AND IMAGE FORMING APPARATUS AND PROCESS CARTRIDGE USING SAME

CROSS-REFERENCE TO RELATED APPLICATIONS

This patent application is based on and claims priority pursuant to 35 U.S.C. §119 to Japanese Patent Applications Nos. 201-187830 and 2011-141381, filed on Aug. 25, 2010 and Jun. 27, 2011, respectively, in the Japan Patent Office, the entire disclosure of which is hereby incorporated herein by reference.

FIELD OF THE INVENTION

This disclosure relates to an electrophotographic photoreceptor, and to an image forming apparatus and a process cartridge using the photoreceptor.

BACKGROUND OF THE INVENTION

Electrophotographic photoreceptors (hereinafter sometimes referred to as photoreceptors) need have a charge retaining function of retaining a charge in a dark place, a charge generating function of generating a charge upon receipt of light, and a charge transporting function of transporting a charge generated upon receipt of light. Such photoreceptors are broadly classified into single-layered type photoreceptors having a layer having all of the above-mentioned functions, and functionally separated multilayer photoreceptors having a charge generation layer which mainly contributes to charge generation and a charge transport layer which contributes to retention of a charge in a dark place and to transport of a charge generated upon receipt of light.

Specific examples of image forming methods using such a photoreceptor include methods using the Carlson process, which typically include the following processes:

(1) charging a photoreceptor in a dark place using corona discharging (charging process);
(2) irradiating the charged photoreceptor with an optical image of an original image such as character images and pictorial images to form an electrostatic latent image on the photoreceptor (latent image forming process);
(3) developing the electrostatic latent image with a developer including a toner to form a toner image on the photoreceptor (developing process);
(4) transferring the toner image onto a recording material (transferring process); and
(5) fixing the toner image on the recording material (fixing process).

After transferring the toner image, the photoreceptor is optionally subjected to other processes such as a discharging process (an electrostatic discharging process or an optical discharging process) of discharging a residual charge on the photoreceptor after transferring the toner image; and a cleaning process of cleaning the surface of the photoreceptor after transferring the toner image, so as to be used for the next image forming processes.

Recently, organic photoreceptors using organic photosensitive materials have been broadly used for electrophotographic image forming apparatuses because of having a good combination of flexibility, thermal stability and film formability. Among such organic photoreceptors, functionally separated multilayer photoreceptors having a photosensitive layer including a charge generation layer including a charge generation material, and a charge transport layer including a charge transport material have been broadly used. Particularly, negatively chargeable photoreceptors having a charge generation layer in which an organic pigment serving as a charge generation material is deposited to form a layer thereof or in which an organic pigment is dispersed in a binder resin, and a charge transport layer in which an organic low molecular weight material serving as a charge transport material is dispersed in a binder resin have been frequently proposed as the functionally separated multilayer photoreceptors.

In addition, recently electrophotographic image forming apparatuses are required to produce full color images and/or to perform high speed image formation so as to have new uses such as small office home office (SOHO) use and printing use as well as office use. In printing use, a greater number of print images are produced per one image forming operation, and there are strict requirements with respect to image qualities. Therefore, the organic photoreceptors used for such electrophotographic image forming apparatuses need have a good combination of durability and electrostatic stability.

In attempting to enhance durability, a technique in which a crosslinked layer is formed as an outermost layer of a photoreceptor is proposed. In this regard, the crosslinked layer is formed by subjecting a material to a three-dimensional crosslinking treatment using energy such as light or electron beams to enhance the abrasion resistance of the photoreceptor. In addition, there are proposals, in which a particulate inorganic or organic material is included in a crosslinked outermost layer, in attempting to further enhance the abrasion resistance. Although the abrasion resistance of a photoreceptor can be enhanced by forming one of these outermost layers thereon, the electrostatic stability of the photoreceptor cannot be fully enhanced.

The reasons why a photoreceptor having a crosslinked outermost layer has an insufficient electrostatic stability is not yet determined, but one of the reasons is considered to be that part of a charge transport material included in the crosslinked material is changed (or decomposed) by the crosslinking energy such as light or electron beams. Specifically, when part of a charge transport material included in the outermost layer is changed by the crosslinking energy, various compounds having different energy levels are present in the outermost layer. In this case, the properties of the photoreceptor are changed after repeated use. For example, decrease of potential of the charged photoreceptor, variation of potential of irradiated portions of the photoreceptor, and decrease of the electric resistance of the surface of the photoreceptor are caused, resulting in deterioration of image qualities such as resolution of images (i.e., formation of blurred images). Since the image qualities are thus deteriorated, the photoreceptor has to be replaced with a fresh photoreceptor, resulting in shortening of the life of the photoreceptor.

Particularly, variation of potential of irradiated portions of the photoreceptor is a serious problem for the image forming apparatuses for use in printing, which are required to have a long life and a high stability. In this regard, variation (job-to-job variation) of potential of irradiated portions of a photoreceptor in a case where the photoreceptor is subjected to one image forming operation, and the next image forming operation is restarted after a pause is more serious than variation (diurnal variation) of potential of irradiated portions of the photoreceptor when the photoreceptor is used for printing images for a relatively long period of time.

Since the diurnal potential variation is not noticeable, and can be corrected in the image forming apparatus, the diurnal potential variation is not a serious problem. By contrast, when a large job-to-job potential variation is caused, change of image qualities of the images is noticeable. Particularly, when the potential of irradiated portions is changed every several or tens of prints, the potential cannot be corrected, thereby causing a serious problem. Particularly, there is a case where a large number of copies of the same image are produced in printing. When a large job-to-job potential variation is caused in such a case, the image density of the copies varies, thereby deteriorating the consistency in image qualities. If the image is a character image, change of the image qualities is hardly noticeable, but when the image is a pictorial full color image, not only the image density but also color tone changes, resulting in occurrence of a serious problem. Therefore, there is a need for a photoreceptor in which the potential of irradiated portions thereof is relatively low while having a low job-to-job variation as well as a low diurnal variation.

In attempting to enhance the electrostatic stability of photoreceptor, various proposals have been made.

For example, there is a proposal for a photoreceptor which has an outermost layer formed by crosslinking a radically polymerizable tri- or more-functional monomer having no charge transport structure and another radically polymerizable monomer having a charge transport structure to impart a good combination of durability and electrostatic stability to the photoreceptor. In addition, another photoreceptor is proposed, in which a polymer obtained by polymerizing and/or crosslinking a compound selected from specific benzidine compounds and a compound selected from specific triphenyl amine compounds is included in the outermost layer to enhance the electric properties of the outermost layer. However, when a charge transport material is polymerized or crosslinked, freedom of the molecules of the material is deteriorated, resulting in deterioration of the charge transport function of the material. In addition, since a reactive charge transport material is used, it is possible that the resultant layer includes an unreacted charge transport material, and/or the charge transport structure thereof is changed when the crosslinking reaction and the polymerization reaction are performed. In this case, the thus degenerated charge transport material is easily affected by acidic gasses, thereby easily causing a problem in that charges are stored in the layer, resulting in deterioration of the electrostatic stability of the photoreceptor.

In addition, in attempting to prevent deterioration of the electric properties of photoreceptor, a photoreceptor is proposed, in which a charge transport polymer is used for a charge transport layer located below a crosslinked outermost layer to prevent migration of the charge transport material to the outermost layer. However, deterioration of the charge transport material included in the outermost layer cannot be prevented when crosslinking the outermost layer using light or electron beams.

Further, another proposal is made, in which an outermost layer is crosslinked using ultraviolet rays with wavelengths of not greater than 310 nm, which can be easily absorbed by organic materials, so that the ultraviolet rays are absorbed only by the surface portion of the layer, in attempting to prevent deterioration of the charge transport material included in the outermost layer. However, it is impossible that the UV crosslinkable charge transport material used for the outermost layer does not absorb the ultraviolet rays, and thereby molecules of the charge transport material are deteriorated, resulting in deterioration of the electrostatic stability of the photoreceptor.

Furthermore, a photoreceptor is proposed, which includes a crosslinked charge transport layer, which is prepared using a radically polymerizable monomer having a charge transport property and which includes a low molecular weight charge transport material, to enhance the electrostatic stability of the photoreceptor. However, when irradiating the charge transport layer with ultraviolet rays to crosslink the layer, the radically polymerizable monomer and the low molecular weight charge transport material are deteriorated, resulting in deterioration of the electrostatic stability of the photoreceptor.

There is another proposal, which includes a photosensitive layer obtained by crosslinking a mixture of a first charge transport material having an acryloyloxy or methacryloyloxy group, and a second charge transport material having a hydroxyl group so that the second charge transport material having a hydroxyl group is incorporated in the three dimensional network of the first charge transport material, and therefore the charge transport groups of the first charge transport material can take an ideal position. However, the second charge transport material having a hydroxyl group has high affinity to moisture, and therefore the photosensitive layer cannot exhibit high stability to withstand environmental conditions. In addition, since two or more charge transport materials having different energy levels are present in the layer, charge transporting cannot be smoothly performed therebetween, thereby deteriorating the electric properties of the layer, resulting in deterioration of the electrostatic stability of the photoreceptor.

Because of these reasons, the inventors recognized that there is a need for a photoreceptor which has a good durability while having little diurnal potential variation and little job-to-job potential variation and which can stably produce high quality images without forming low density images and blurred images.

BRIEF SUMMARY OF THE INVENTION

As an aspect of this disclosure, a photoreceptor is provided which includes at least an electroconductive substrate, a photosensitive layer located overlying the electroconductive substrate, and a crosslinked outermost layer located overlying the photosensitive layer and including a crosslinked material and a carbazole compound serving as a charge transport material and having the following formula (1):

(1)

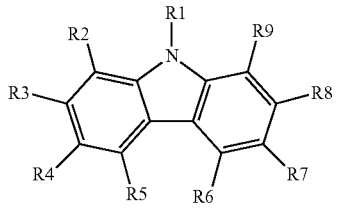

In formula (1), each of R1 to R9 represents a hydrogen atom, a nitro group, a cyano group, a halogen atom, a hydroxyl group, a saturated or unsaturated aliphatic hydrocarbon group which optionally has a substituent, a substituted or unsubstituted aromatic hydrocarbon group, a substituted or unsubstituted alkoxyl group, a substituted or unsubstituted aryloxy group, an amino group, a substituted or unsubstituted dialkylamino group, or a substituted or unsubstituted diarylamino group, wherein each of combinations R3 and R4, R4 and R5, R6 and R7, and R7 and R8 optionally shares bond connectivity to form a ring.

In this regard, "overlying" can include direct contact and allow for one or more intermediate layers. In addition, the substituents that the above-mentioned groups optionally have do not include reactive substituents.

As another aspect of this disclosure, an image forming apparatus is provided which includes the above-mentioned photoreceptor, a charger to charge the photoreceptor, an irradiator to irradiate the charged photoreceptor with light to form an electrostatic latent image thereon, a developing device to develop the electrostatic latent image with a developer including a toner to form a toner image thereon, and a transferring device to transfer the toner image onto a recording material.

As yet another aspect of this disclosure, a process cartridge is provided which include the above-mentioned photoreceptor, and at least one of a charger, a developing device, a transferring device, a cleaning device to clean the surface of the photoreceptor after transferring a toner image, and a discharger to decay residual charges remaining on the photoreceptor even after transferring a toner image.

The aforementioned and other aspects, features and advantages will become apparent upon consideration of the following description of the preferred embodiments taken in conjunction with the accompanying drawings.

DETAILED DESCRIPTION OF THE INENTION

Figure 1:
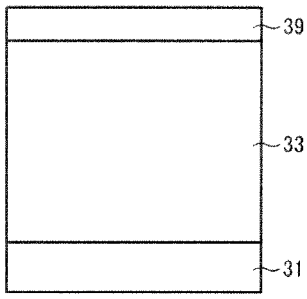
FIG. 1 is a schematic cross-sectional view illustrating an example of the photoreceptor of this disclosure.

The photoreceptor of this disclosure includes at least an electroconductive substrate, a photosensitive layer located overlying the electroconductive substrate, and a crosslinked outermost layer located overlying the photosensitive layer and including a crosslinked material and a carbazole compound having the following formula (1):

(1)

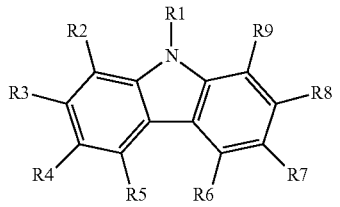

In formula (1), each of R1 to R9 represents a hydrogen atom, a nitro group, a cyano group, a halogen atom, a hydroxyl group, a saturated or unsaturated aliphatic hydrocarbon group which optionally has a substituent, a substituted or unsubstituted aromatic hydrocarbon group, a substituted or unsubstituted alkoxyl group, a substituted or unsubstituted aryloxy group, an amino group, a substituted or unsubstituted dialkylamino group, or a substituted or unsubstituted diarylamino group, wherein each of combinations R3 and R4, R4 and R5, R6 and R7, and R7 and R8 optionally shares bond connectivity to form a ring.

In this regard, "overlying" can include direct contact and allow for one or more intermediate layers. In addition, the substituents that the above-mentioned groups optionally have do not include reactive substituents.

When a carbazole compound having formula (1) is included in the crosslinked outermost layer of a photoreceptor, alteration of a charge transport material included in the photoreceptor, which is caused by irradiation of light or electron beams to crosslink the outermost layer, can be suppressed. Namely, the resultant photoreceptor can maintain good properties (such as electrostatic properties and charge decaying properties (e.g., low potential after irradiation and low residual potential) without deteriorating the charge transport function thereof even after a long repeated use while reducing the job-to-job potential variation. Therefore, high quality images can be stably produced by the photoreceptor over a long period of time.

In addition, by using the above-mentioned photoreceptor, an electrophotographic image forming method, an image forming apparatus, and a process cartridge, by which high quality images with little variation in image density and color tone (i.e., images having good consistency in image qualities) can be produced.

Carbazole compounds having formula (1) hardly change their absorbance spectra even after exposed to UV rays. This is because carbazole compounds hardly cause molecular decomposition when being exposed to light, and have good resistance to UV rays. Therefore, by using carbazole compounds, occurrence of a problem in that compounds having different energy levels are present in the crosslinked outermost layer can be prevented, and the properties (such as electrostatic properties) of the photoreceptor are hardly changed even when the photoreceptor is exposed to UV rays. In addition, carbazole compounds are stable to reactive groups having radicals generated in a crosslinking treatment, and hardly produce such by-products as to deteriorate the properties of the photoreceptor. Therefore, the electrostatic properties of the photoreceptor are hardly changed even when the photoreceptor is exposed to UV rays.

In contrast, popular charge transport materials change their absorbance spectra when being exposed to UV rays. The reason therefor is considered to be that such charge transport materials cause any changes such as decomposition when light energy is applied thereto.

When a light crosslinkable outermost layer including a charge transport material is subjected to a crosslinking treatment to form a film of the layer, decomposition and the like of the charge transport material tend to be caused as mentioned above, and therefore there are various compounds having different energy levels in the layer. These compounds change the properties of the photoreceptor after long repeated use, i.e., the compounds cause various problems such as decrease of potential of the charged photoreceptor, variation of potential VL of irradiated portions of the photoreceptor, and decrease of surface resistivity of the photoreceptor, resulting in deterioration of image qualities (such as deterioration of resolution and formation of blurred images).

Any carbazole compounds with or without a crosslinkable group have good resistance to UV rays. However, when carbazole compounds having a crosslinkable group are crosslinked, the molecules of the crosslinked carbazole compounds lose their flexibility, resulting in deterioration of the charge transportability thereof. When the amount of light energy applied to such crosslinkable carbazole compounds is decreased to avoid such a problem, non-crosslinked compounds remain in the resultant layer and the cross-linkage density decreases, resulting in deterioration of the abrasion resistance of the layer. In addition, carbazole compounds, which have a crosslinkable group but are not crosslinked, have an unreacted crosslinkable group. Since such an unreacted crosslinkable group has a high polarity and easily adsorbs or reacts with oxidation gasses, the photoreceptor including such carbazole compounds is easily deteriorated by products (e.g., oxidation gasses) caused by discharging of a charger in a charging process after repeated use, thereby forming blurred images due to variation of potential VL of irradiated portions and decrease of resistivity of the photoreceptor caused by charge trapping. Namely, the photoreceptor cannot maintain good electrostatic properties.

In contrast, carbazole compounds having no crosslinkable group have good resistance to UV rays while being stable to radicals formed in a crosslinking process or reactive groups of crosslinkable materials used for forming the outermost layer. Therefore, the carbazole compounds do not form byproducts in the crosslinking process, and the resultant photoreceptor can maintain good electrostatic stability over a long period of time.

It is described in "Ultraviolet Light Photofatigue of Organic Photoreceptors" by David S. WISS and William T. GRUENBAUM, Journal of Image Society of Japan, Vol. 47, No. 6, pp 501-507 (2008) that triphenylamine compounds are easily deteriorated by UV rays and several new compounds such as carbazole compounds are produced, resulting in deterioration of the charge transport function of the compounds. The present inventors consider that according to this paper carbazole compounds may have good resistance to UV rays and that it may be possible to prepare a photoreceptor having good electrostatic properties by using a carbazole compound as a charge transport material in the outermost layer of the photoreceptor.

Carbazole compounds having formula (1) have good resistance to UV rays, and hardly produce such byproducts as to deteriorate electrophotographic properties of the resultant photoreceptor even when radicals and reactive groups are formed in the crosslinking process. Therefore, by using such carbazole compounds for the outermost layer, good charge transport function can be imparted to the photoreceptor because the compounds are hardly deteriorated in the crosslinking process.

Among the carbazole compounds having formula (1), carbazole compounds having the below-mentioned formula (2) have better resistance to UV rays. Therefore, by using such carbazole compounds for the outermost layer, deterioration of the photoreceptor in the crosslinking process can be further reduced.

(2)

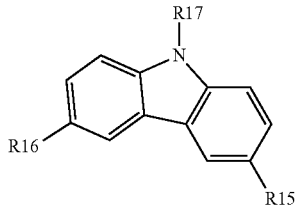

In formula (2), each of R15 and R16 represents a hydrogen atom, a saturated or unsaturated aliphatic hydrocarbon group which has 1 to 4 carbon atoms and which optionally has a substituent, or a substituted or unsubstituted aromatic hydrocarbon group; and R17 represents a saturated or unsaturated aliphatic hydrocarbon group which has 1 to 4 carbon atoms and which optionally has a substituent, or a substituted or unsubstituted phenyl or biphenyl group.

In addition, among the carbazole compounds having formula (1), carbazole compounds having the below-mentioned formula (3) have better charge transportability, and can impart better electrostatic stability to the photoreceptor.

(3)

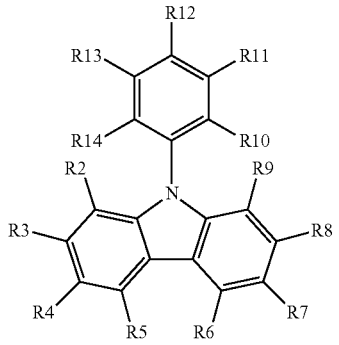

In formula (3), each of R2 to R14 represents a hydrogen atom, a nitro group, a cyano group, a halogen atom, a hydroxyl group, a saturated or unsaturated aliphatic hydrocarbon group which optionally has a substituent, a substituted or unsubstituted aromatic hydrocarbon group, a substituted or unsubstituted alkoxyl group, a substituted or unsubstituted aryloxy group, an amino group, a substituted or unsubstituted dialkylamino group, or a substituted or unsubstituted diarylamino group, wherein each of combinations R3 and R4, R4 and R5, R6 and R7, R7 and R8, R11 and R12, and R12 and R13 optionally shares bond connectivity to form a ring.

Among the carbazole compounds having formula (2) or (3), carbazole compounds having the below-mentioned formula (4) have better charge transportability, and better resistance to UV rays.

(4)

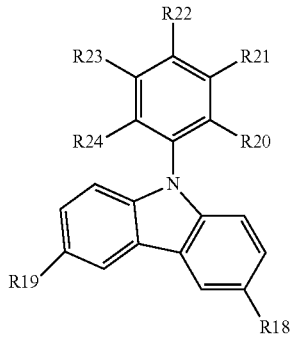

In formula (4), each of R18 and R19 represents a hydrogen atom, a saturated or unsaturated aliphatic hydrocarbon group which has 1 to 4 carbon atoms and which optionally has a substituent, or a substituted or unsubstituted aromatic hydrocarbon group; each of R20, R21, R23 and R24 represents a hydrogen atom, or a saturated or unsaturated aliphatic hydrocarbon group which has 1 to 4 carbon atoms and which optionally has a substituent; and R22 represents a hydrogen atom, a substituted or unsubstituted aliphatic hydrocarbon group which has 1 to 4 carbon atoms and which optionally has a substituent, or a substituted or unsubstituted aromatic hydrocarbon group.

Further, among the carbazole compounds having formula (4), carbazole compounds having the below-mentioned formula (5) have better charge transportability, and therefore the resultant photoreceptor can maintain good electrostatic stability over a long period of time.

(5)

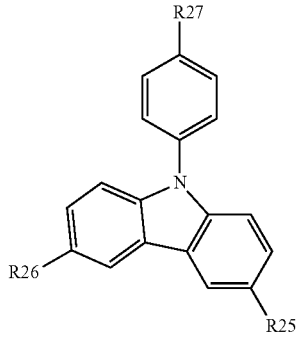

In formula (5), each of R25 and R26 represents a hydrogen atom, a saturated or unsaturated aliphatic hydrocarbon group which has 1 to 4 carbon atoms and which optionally has a substituent, or a substituted or unsubstituted aromatic hydrocarbon group; and R27 represents a hydrogen atom, a saturated or unsaturated aliphatic hydrocarbon group which has 1 to 4 carbon atoms and which optionally has a substituent, or an aromatic hydrocarbon group optionally substituted with an aliphatic hydrocarbon group having 1 to 4 carbon atoms.

Among the carbazole compounds having formula (2), carbazole compounds having the below-mentioned formula (6) have better charge transportability and better resistance to UV rays, and therefore the resultant photoreceptor has better electrostatic stability.

(6)

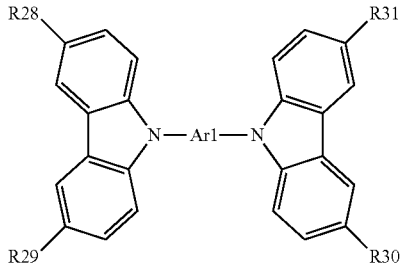

In formula (6), Ar1 represents a phenylene group, a biphenylene group, or a saturated or unsaturated aliphatic hydrocarbon group having 1 to 4 carbon atoms; and each of R28, R29, R30 and R31 represents a hydrogen atom, a saturated or unsaturated aliphatic hydrocarbon group which has 1 to 4 carbon atoms and which optionally has a substituent, or a substituted or unsubstituted aromatic hydrocarbon group.

Among the carbazole compounds having formula (1), carbazole compounds having the below-mentioned formula (7) have better charge transportability and better resistance to UV rays, and very stable to reactive groups generated in a crosslinking process. Therefore, the resultant photoreceptor better electrostatic stability.

(7)

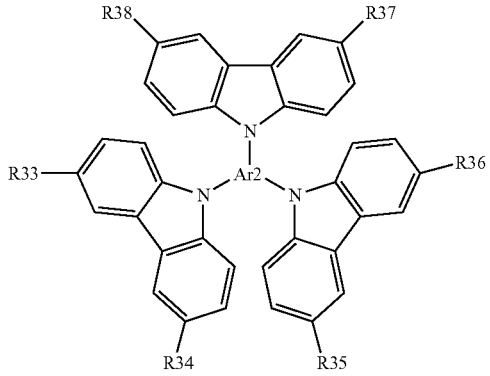

In formula (7), Ar2 represents a phenylyne group, or a triphenyl amine group; and each of R33, R34, R35, R36, R37 and R38 represents a hydrogen atom, a saturated or unsaturated aliphatic hydrocarbon group which has 1 to 4 carbon atoms and which optionally has a substituent, or a substituted or unsubstituted aromatic hydrocarbon group.

The crosslinked material included in the crosslinked outermost layer has a unit obtained from a radically polymerizable compound having no charge transport structure. Namely, the crosslinked material is preferably prepared by polymerizing and crosslinking one or more radically polymerizable compounds having no charge transport structure. At least one of the radically polymerizable compounds preferably has three or more functional groups.

The crosslinked outermost layer preferably includes a particulate inorganic or organic material to enhance the mechanical durability of the photoreceptor.

By using the photoreceptor for an image forming apparatus or a process cartridge, high quality images can be produced over a long period of time.

Initially, the structure of the photoreceptor of this disclosure will be described by reference to drawings.

FIG. 1 is a schematic cross-sectional view illustrating an example of the photoreceptor of this disclosure. The photoreceptor includes an electroconductive substrate 31, a photosensitive layer 33 located on the electroconductive substrate 31 and including a charge generation material and a charge transport material as main components, and a crosslinked outermost layer 39 located on the photosensitive layer 33.

Figure 2:
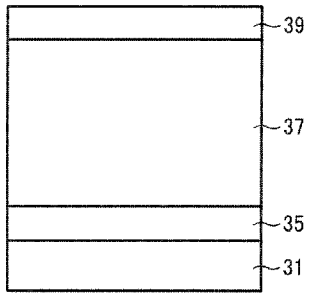
FIG. 2 is a schematic cross-sectional view illustrating another example of the photoreceptor of this disclosure.

FIG. 2 is a schematic cross-sectional view illustrating another example of the photoreceptor of this disclosure. The photoreceptor includes the electroconductive substrate 31, a charge generation layer 35 located on the electroconductive substrate 31 and including a charge generation material as a main component, a charge transport layer 37 located on the charge transport layer 35 and including a charge transport material as a main component, and the crosslinked outermost layer 39 located on the charge transport layer 37.

The electroconductive substrate 31 is not particularly limited as long as the substrate has a volume resistivity of not greater than $10^{10}\Omega\cdot$cm. Specific examples of such materials include plastic cylinders, plastic films or paper sheets, on the surface of which a layer of a metal such as aluminum, nickel, chromium, nichrome, copper, gold, silver, platinum and the like, or a layer of a metal oxide such as tin oxides, indium oxides and the like, is formed by deposition or sputtering. In addition, a plate of a metal such as aluminum, aluminum alloys, nickel and stainless steel can be used. A metal cylinder, which is prepared by tubing a metal such as aluminum, aluminum alloys, nickel and stainless steel using a method such as impact ironing or direct ironing, and then subjecting the surface of the tube to cutting, super finishing, polishing and the like treatments, can also be used as the substrate. Further, endless nickel or stainless steel belts disclosed in published unexamined Japanese patent application No. 52-36016 can also be used as the substrate.

Furthermore, substrates, in which a coating liquid including a binder resin and an electroconductive powder is coated on the supports mentioned above, can be used as the electroconductive substrate 31. Specific examples of such an electroconductive powder include carbon black, acetylene black, powders of metals such as aluminum, nickel, iron, nichrome, copper, zinc, silver and the like, and metal oxides such as electroconductive tin oxides, ITO, and the like. Specific examples of the binder resin include known thermoplastic resins, thermosetting resins and photo-crosslinking resins, such as polystyrene, styrene-acrylonitrile copolymers, styrene-butadiene copolymers, styrene-maleic anhydride copolymers, polyesters, polyvinyl chloride, vinyl chloride-vinyl acetate copolymers, polyvinyl acetate, polyvinylidene chloride, polyarylates, phenoxy resins, polycarbonates, cellulose acetate resins, ethyl cellulose resins, polyvinyl butyral resins, polyvinyl formal resins, polyvinyl toluene, poly-N-vinyl carbazole, acrylic resins, silicone resins, epoxy resins, melamine resins, urethane resins, phenolic resins, alkyd resins, and the like.

Such an electroconductive layer can be formed by coating a coating liquid in which an electroconductive powder and a binder resin are dispersed or dissolved in a proper solvent such as tetrahydrofuran, dichloromethane, methyl ethyl ketone, toluene and the like solvent, and then drying the coated liquid.

In addition, substrates, in which an electroconductive resin film is formed on a surface of a cylindrical substrate using a heat-shrinkable resin tube which is made of a combination of a resin such as polyvinyl chloride, polypropylene, polyesters, polyvinylidene chloride, polyethylene, chlorinated rubber and fluorine-containing resins (such as TEFLON), with an electroconductive material, can also be used as the electroconductive substrate 31.

Next, the photosensitive layer will be described.

The photosensitive layer of the photoreceptor of this disclosure may be a single-layered photosensitive layer (such as the photoreceptor illustrated in FIG. 1) or a multilayer photosensitive layer (such as the photoreceptor illustrated in FIG. 2). The multi-layer photosensitive layer will be described only for convenience of explanation.

The charge generation layer 35 includes a charge generation material as a main component.

Known charge generation materials can be used as the charge generation material. Specific examples thereof include monazo pigments, disazo pigments, trisazo pigments, perylene pigments, perynone pigments, quinacridone pigments, polycyclic quinone pigments, squaric acid dyes, phthalocyanine pigments, naphthalocyanine pigments, azulenium salt type pigments, and the like. These charge generation materials can be used alone or in combination.

The method for forming the charge generation layer is not particularly limited. Specific examples thereof include a method including preparing a coating liquid by dispersing a charge generation material in a solvent optionally together with a binder resin using a dispersing machine such as ball mills, attritors, sand mills, and ultrasonic dispersing machines; and coating the coating liquid, which is optionally diluted, on an electroconductive substrate, followed by drying the coated liquid, to prepare the charge generation layer.

Specific examples of the binder resins, which are optionally included in the charge generation layer coating liquid, include polyamide, polyurethane, epoxy resins, polyketone, polycarbonate, silicone resins, acrylic resins, polyvinyl butyral, polyvinyl formal, polyvinyl ketone, polystyrene, polysulfone, poly-N-vinylcarbazole, polyacrylamide, polyvinyl benzal, polyester, phenoxy resins, vinyl chloride-vinyl acetate copolymers, polyvinyl acetate, polyphenylene oxide, polyvinyl pyridine, cellulose resins, casein, polyvinyl alcohol, polyvinyl pyrrolidone, and the like. These resins can be used alone or in combination. The added amount of the binder resins is generally from 0 to 500 parts by weight, and preferably from 10 to 300 parts by weight, per 100 parts by weight of the charge generation material included in the charge generation layer. In this regard, a binder resin is optionally mixed with the charge generation material before or after dispersing the charge generation material.

Specific examples of the solvent for use in preparing the charge generation layer coating liquid include organic solvents such as isopropanol, acetone, methyl ethyl ketone, cyclohexanone, tetrahydrofuran, dioxane, ethyl cellosolve, ethyl acetate, methyl acetate, dichloromethane, dichloroethane, monochlorobenzene, cyclohexane, toluene, xylene, ligroin, and the like. Among these solvents, ketones, esters and ethers are preferably used. These solvents can be used alone or in combination.

The charge generation layer coating liquid typically includes a charge generation material, a solvent and a binder resin as main components, and can further include additives such as sensitizers, dispersants, surfactants, and silicone oils.

The charge generation layer is typically prepared by coating the above-prepared charge generation layer coating liquid on an electroconductive substrate with an optional undercoat layer therebetween, followed by drying. Suitable coating methods include known coating methods such as dip coating, spray coating, bead coating, nozzle coating, spinner coating, ring coating, and the like.

The thickness of the charge generation layer 35 is generally from 0.01 μm to 5 μm, and preferably from 0.1 μm to 2 μm.

The charge transport layer includes a charge transport material as a main component. The content of a charge transport material in the charge transport layer 37 is preferably from 30 to 200 parts by weight per 100 parts by weight of the binder resin components included in the charge transport layer. When the content is lower than 30 parts by weight, the electric properties of the resultant photoreceptor deteriorate (for example, the residual potential (i.e., the potential of an irradiated portion of the photoreceptor increases). In contrast, when the content is higher than 200 parts, the mechanical properties of the photoreceptor deteriorate (for example, the abrasion resistance of the photoreceptor deteriorates).

Charge transport materials are classified into positive-hole transport materials and electron transport materials. Specific examples of the electron transport materials include electron accepting materials such as chloranil, bromanil, tetracyanoethylene, tetracyanoquinodimethane, 2,4,7-trinitro-9-fluorenon, 2,4,5,7-tetranitro-9-fluorenon, 2,4,5,7-tetranitroxanthone, 2,4,8-trinitrothioxanthone, 2,6,8-trinitro-4H-indeno [1,2-b]thiophene-4-one, 1,3,7-trinitrodibenzothiophene-5,5-dioxide, benzoquinone derivatives, and the like.

Specific examples of the positive-hole transport materials include known materials such as poly-N-vinyl carbazole and its derivatives, poly-γ-carbazolylethylglutamate and its derivatives, pyrene-formaldehyde condensation products and their derivatives, polyvinyl pyrene, polyvinyl phenanthrene, polysilane, oxazole derivatives, oxadiazole derivatives, imidazole derivatives, monoarylamines, diarylamines, triarylamines, stilbene derivatives, α-phenyl stilbene derivatives, benzidine derivatives, diarylmethane derivatives, triarylmethane derivatives, 9-styrylanthracene derivatives, pyrazoline derivatives, divinyl benzene derivatives, hydrazone derivatives, indene derivatives, butadiene derivatives, pyrene derivatives, bisstilbene derivatives, enamine derivatives, and the like.

These charge transport materials can be used alone or in combination.

Specific examples of the materials for use as the binder resin in the charge transport layer 37 include thermoplastic resins and thermosetting resins such as polystyrene resins, styrene-acrylonitrile copolymers, styrene-butadiene copolymers, styrene-maleic anhydride copolymers, polyester resins, polyvinyl chloride resins, vinyl chloride-vinyl acetate copolymers, polyvinyl acetate resins, polyvinylidene chloride resins, polyarylate resins, phenoxy resins, polycarbonate resins, cellulose acetate resins, ethyl cellulose resins, polyvinyl butyral resins, polyvinyl formal resins, polyvinyl toluene resins, poly-N-vinylcarbazole resins, acrylic resins, silicone resins, epoxy resins, melamine resins, urethane resins, phenolic resins, alkyd resins, and the like. These resins can be used alone or in combination.

The thickness of the charge transport layer 37 is preferably not greater than 50 μm, and more preferably not greater than 25 μm in view of the needs for resolution of images and response of the photoreceptor. The lower limit of the thickness is determined based on the performance (e.g., charging conditions (such as potential of the charge photoreceptor)) of the image forming system for which the photoreceptor is used, and the thickness is generally not less than 5 μm.

The method for preparing the charge transport layer is not particularly limited. For example, a method including preparing a charge transport layer coating liquid by dissolving or dispersing a charge transport material and a binder resin in a solvent; coating the coating liquid on the charge generation layer; and drying the coated liquid, can be used.

Specific examples of the solvent for use in the charge transport layer coating liquid include tetrahydrofuran, dioxane, toluene, dichloromethane, monochlorobenzene, dichloroethane, cyclohexanone, methyl ethyl ketone, acetone, and the like. These solvents can be used alone or in combination.

Specific examples of the coating method for use in preparing the charge transport layer include known coating methods such as spray coating, bead coating, nozzle coating, spinner coating, and ring coating.

Next, the single-layered photosensitive layer will be described.

The photosensitive layer 33 can be prepared, for example, by applying a coating liquid, which is prepared by dissolving or dispersing a composition including a charge generation material, a charge transport material, and a binder resin, overlying the electroconductive substrate 31, and then drying the coated liquid. The photosensitive layer coating liquid can optionally include additives such as plasticizers, leveling agents, and antioxidants.

The charge generation materials, charge transport materials and binder resins mentioned above for use in the charge generation layer 35 and the charge transport layer 37 can also be used for the photosensitive layer 33.

The photosensitive layer 33 preferably includes a charge transport material selected from the electron transport materials mentioned above to enhance the sensitivity of the photoreceptor.

The content of the charge generation material in the photosensitive layer 33 is from 0.1% to 30% by weight, and preferably from 0.5% to 5% by weight, based on the total weight of the photosensitive layer. When the content of the charge generation material is lower than 0.1% by weight, the sensitivity of the photoreceptor deteriorates. In contrast, when the content is higher than 30% by weight, the charging properties of the photoreceptor and the strength of the photosensitive layer deteriorate.

The content of the charge transport material in the photosensitive layer 33 is preferably from 30 to 200 by weight based on 100 parts by weight of the total weight of the binder resin components included in the photosensitive layer. In addition, the content of an electron transport material in the photosensitive layer is preferably from 30 to 200 parts by weight.

The thickness of the single-layered photosensitive layer 33 is preferably not greater than 50 μm, and more preferably not greater than 25 μm in view of the needs for resolution of images and response of the photoreceptor. The lower limit of the thickness is determined based on the performance (e.g., charging conditions (such as potential of the charge photoreceptor)) of the image forming system for which the photoreceptor is used, and the thickness is preferably not less than 5 μm.

Next, the crosslinked outermost layer will be described.

The crosslinked outermost layer includes, as main components, a crosslinked material having a unit obtained from a radically polymerizable compound having no charge transport function, and a charge transport material having the following formula (1):

(1)

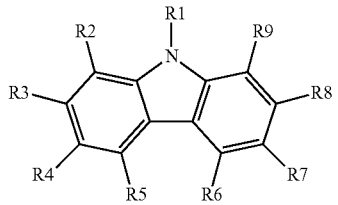

In formula (1), each of R1 to R9 represents a hydrogen atom, a nitro group, a cyano group, a halogen atom, a hydroxyl group, a saturated or unsaturated aliphatic hydrocarbon group which optionally has a substituent, a substituted or unsubstituted aromatic hydrocarbon group, a substituted or unsubstituted alkoxyl group, a substituted or unsubstituted aryloxy group, an amino group, a substituted or unsubstituted dialkylamino group, or a substituted or unsubstituted diarylamino group, wherein each of combinations R3 and R4, R4 and R5, R6 and R7, and R7 and R8 optionally shares bond connectivity to form a ring.

The crosslinked outermost layer of the photoreceptor of this disclosure is typically prepared by coating a coating liquid, which is prepared by dissolving a radically polymerizable compound, a charge transport material having formula (1) and a photo-polymerization initiator in a solvent, on the charge transport layer or the single-layered photosensitive layer mentioned above; and then irradiating the coated layer with light or electron beams to crosslink the layer.

The added amount of the charge transport material having formula (1) is from 20 to 200 parts by weight based on 100 parts by weight of the radically polymerizable compound included in the outermost layer coating liquid. When the added amount is smaller than 20 parts by weight, the electric properties of the photoreceptor deteriorate (for example, the residual potential (i.e., the potential of an irradiated portion) of the photoreceptor increases). In contrast, when the added amount is larger than 200 parts by weight, the density of cross-linkage in the outermost layer decreases, resulting in deterioration of the abrasion resistance of the photoreceptor.

Next, the materials used for forming the crosslinked outermost layer will be described in detail.

Initially, the radically polymerizable compound having no charge transport function will be described.

The radically polymerizable compound has three or more radically polymerizable groups and do not have a charge transport structure such as positive hole transport structures (e.g., triarylamine, hydrazone, pyrazoline and carbazole structures), and electron transport structures (e.g., condensed polycyclic quinine structures, diphenoquinone structures, and electron accepting aromatic ring structures having a cyano group or a nitro group). As for the radically polymerizable groups, any radically polymerizable groups, which have a carbon-carbon double bond and which can perform radical polymerization, can be used.

Suitable radically polymerizable groups include 1-substituted ethylene groups and 1,1-substituted ethylene groups, which are mentioned below.

(1) Suitable 1-substituted ethylene groups include functional groups having the following formula (8):

$$CH_2{=}CH{-}X_1{-} \quad (8)$$

wherein $X_1$ represents a substituted or unsubstituted arylene group (such as phenylene and naphthylene groups), a substituted or unsubstituted alkenylene group, a —CO— group, a —COO— group, a —CON($R_1$)— group ($R_1$ represents a hydrogen atom, an alkyl group (e.g., methyl and ethyl groups), an aralkyl group (e.g., benzyl, naphthylmethyl and phenetyl groups), or an aryl group (e.g., phenyl and naphthyl groups)), or a —S— group.

Specific examples of such 1-substituted ethylene groups include a vinyl group, a stylyl group, a 2-methyl-1,3-butadienyl group, a vinylcarbonyl group, an acryloyloxy group, an acryloylamide group, a vinylthioether group, and the like.

(2) Suitable 1,1-substituted ethylene groups include functional groups having the following formula (9):

$$CH_2{=}C(Y){-}(X_2)_j{-} \quad (9)$$

wherein Y represents a substituted or unsubstituted alkyl group, a substituted or unsubstituted aralkyl group, a substituted or unsubstituted aryl group (such as phenyl and naphthyl groups), a halogen atom, a cyano group, a nitro group, an alkoxyl group (such as methoxy and ethoxy groups), or a —$COOR_2$ group (wherein $R_2$ represents a hydrogen atom, a substituted or unsubstituted alkyl group (such as methyl and ethyl groups), a substituted or unsubstituted aralkyl group (such as benzyl and phenethyl groups), a substituted or unsubstituted aryl group (such as phenyl and naphthyl groups) or a —$CONR_3R_4$ group (wherein each of $R_3$ and $R_4$ represents a hydrogen atom, a substituted or unsubstituted alkyl group (such as methyl and ethyl groups), a substituted or unsubstituted aralkyl group (such as benzyl, naphthylmethyl and phenethyl groups), or a substituted or unsubstituted aryl group (such as phenyl and naphthyl groups)); $X_2$ represents a group selected from the groups mentioned above for use in $X_1$, or an alkylene group, wherein at least one of Y and $X_2$ is an oxycarbonyl group, a cyano group, an alkenylene group or an aromatic ring group; and j is 0 or 1.

Specific examples of the 1,1-substituted ethylene groups include an α-chloroacryloyloxy group, a methacryloyloxy group, an α-cyanoethylene group, an α-cyanoacryloyloxy group, an α-cyanophenylene group, a methacryloylamino group, and the like.

Specific examples of the substituents for use in the groups $X_1$, $X_2$ and Y include a halogen atom, a nitro group, a cyano group, alkyl groups (such as methyl and ethyl groups), alkoxy groups (such as methoxy and ethoxy groups), aryloxy groups (such as a phenoxy group), aryl groups (such as phenyl and naphthyl groups), aralkyl groups (such as benzyl and phenethyl groups), and the like.

Among these radically polymerizable functional groups, acryloyloxy groups and methacryloyloxy groups are preferable. Compounds having three or more (meth)acryloyloxy groups can be prepared by subjecting a(meth)acrylic compound such as (meth)acrylic acid (salts), (meth)acrylhalides and (meth)acrylates, and a compound which has three or more hydroxyl groups in a molecule thereof, to an esterification reaction or an ester exchange reaction. The three or more radically polymerizable groups included in a radically polymerizable tri- or more-functional monomer are the same as or different from the others.

Specific examples of the radically polymerizable tri- or more-functional compounds having no charge transport structure include, but are not limited thereto, trimethylolpropane triacrylate (TMPTA), trimethylolpropane trimethacylate, HPA-modified trimethylolpropane triacrylate, ethylene oxide (EO)-modified trimethylolpropane triacrylate, propyleneoxide (PO)-modified trimethylolpropane triacrylate, caprolactone-modified trimethylolpropane triacrylate, HPA-modified trimethylolpropane trimethacrylate, pentaerythritol triacrylate, pentaerythritol tetraacrylate (PETTA), glycerol triacrylate, epichlorohydrin (ECH)-modified glycerol triacrylate, ethyleneoxide (EO)-modified glycerol triacrylate, propyleneoxide (PO)-modified glycerol triacrylate, tris(acryloxyethyl)isocyanurate, dipentaerythritol hexaacrylate (DPHA), caprolactone-modified dipentaerythritol hexaacrylate, dipentaerythritol hydroxypentaacrylate, alkylated dipentaerythritol pentaacrylate, alkylated dipentaerythritol tetraacrylate, alkylated dipentaerythritol triacrylate, dimethylolpropane tetraacrylate (DTMPTA), pentaerhythritol ethoxytetracrylate, ethyleneoxy-modified triacryl phosphate, 2,2,5,5-tetrahydroxymethylcyclopentanone tetraacrylate, and the like. In this regard, "HPA" represents alkylene. These compounds are used alone or in combination.

In order to form a dense crosslinked network in the crosslinked outermost layer, the ratio (Mw/F) of the molecular weight (Mw) of a radically polymerizable compound having no charge transport structure to the number of functional groups (F) included in a molecule of the compound is preferably not greater than 250. In this case, the abrasion resistance of the resultant photoreceptor can be enhanced. When the ratio is too large, the resultant outermost layer becomes soft and thereby the abrasion resistance of the layer slightly is deteriorated. In this case, it is not preferable to use only one monomer having a functional group having a long chain group when the monomer is modified with a group such as ethylene oxide (EO), propylene oxide (PO) and HPA.

The content of the unit obtained from a polymerizable tri- or more-functional compound having no charge transport structure in the crosslinked outermost layer is preferably from 20% to 80% by weight, and more preferably from 35% to 65% by weight, based on the total weight of the outermost layer. When the content is lower than 20% by weight, the three dimensional cross-linkage density is low, and therefore the resultant outermost layer cannot have abrasion resistance much better than that of conventional outermost layers prepared by using a thermoplastic binder resin. In contrast, when the content is higher than 80% by weight, the content of the charge transport compound in the outermost layer decreases, thereby deteriorating the electric properties of the photoreceptor (e.g., residual potential of the photoreceptor is increased). The targets of the abrasion resistance and electrostatic properties of the crosslinked outermost layer are determined depending on the image forming processes for which the photoreceptor is used, and therefore the content of the unit obtained from the radically polymerizable compound having no charge transport structure in the outermost layer is not unambiguously determined. However, the content is preferably from 35 to 65% by weight in order to balance both the properties.

Next, the charge transport material having formula (1) will be described.

The charge transport material having formula (1) is hardly affected by crosslinking energy such as light and electron beams. Specifically, decomposition and reaction of the charge transport material having formula (1) are hardly caused thereby. Therefore, charge trapping is not caused in the crosslinked outermost layer, and the resultant photoreceptor can maintain good electric properties even after long repeated use.

Specific examples of the charge transport material having formula (1) include the following carbazole compounds illustrated in Tables 1-1 to 1-3, but are not limited thereto. These carbazole compounds are marketed, and can be easily available from, for example, NIHON JYORYU KOGYO CO., LTD, and Tokyo Kasei Kogyo Co., Ltd.

TABLE 1-1

No. 1

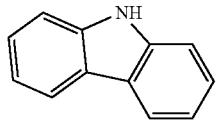

No. 2

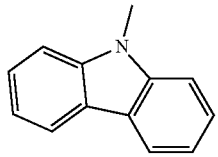

No. 3

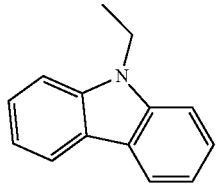

No. 4

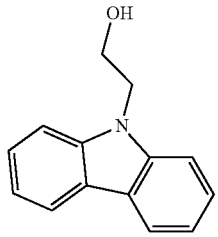

No. 5

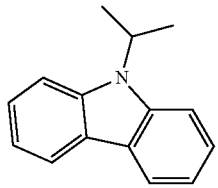

No. 6

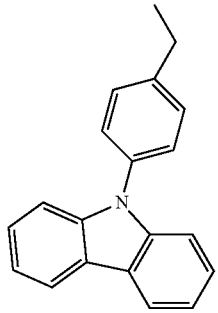

No. 7

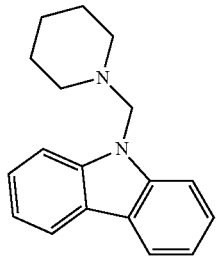

TABLE 1-1-continued
No. 8
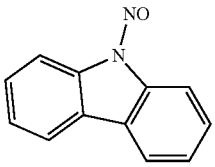
No. 9
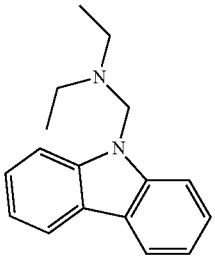
TABLE 1-2
No. 10
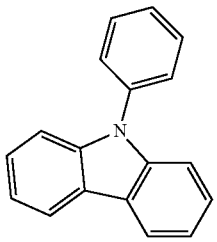
No. 11
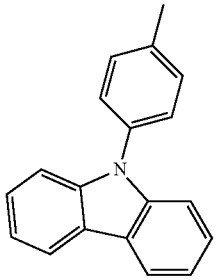
No. 12
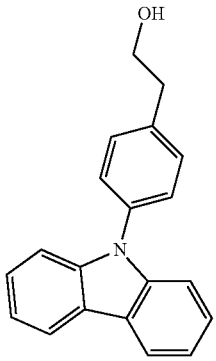
TABLE 1-2-continued
No. 13
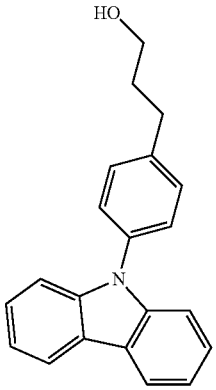
No. 14
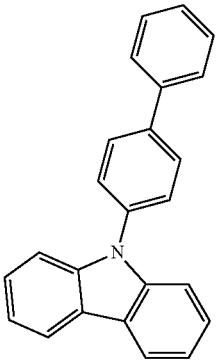
No. 15
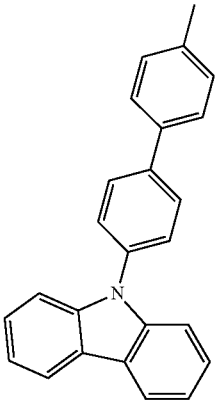
No. 16
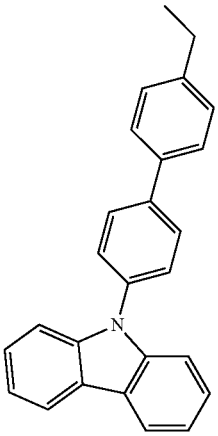

TABLE 1-2-continued

No. 17

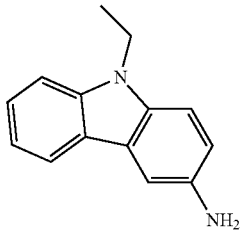

No. 18

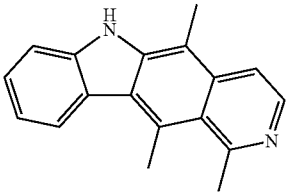

TABLE 1-3

No. 19

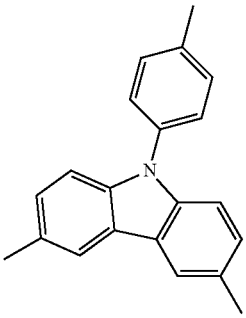

No. 20

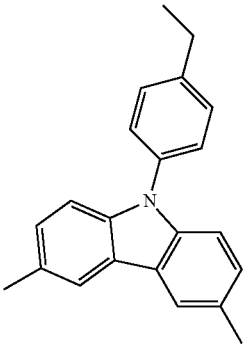

No. 21

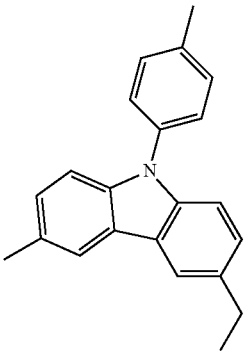

TABLE 1-3-continued

No. 22

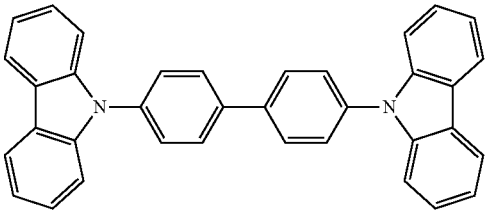

No. 23

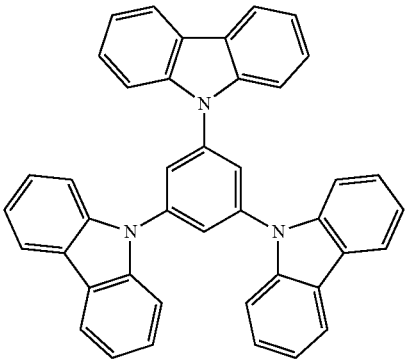

No. 24

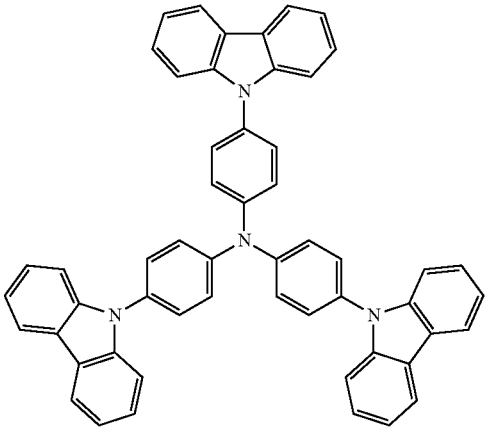

No. 25

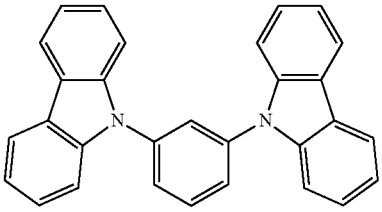

Such charge transport materials are included in the outermost layer to impart good charge transportability to the outermost layer. The content of a charge transport material in the crosslinked outermost layer is preferably from 20 to 80% by weight, and more preferably from 35 to 65% by weight, based on the total weight of the outermost layer. When the content is lower than 20% by weight, the resultant outermost layer has insufficient charge transportability, thereby deteriorating the electric properties of the photoreceptor, resulting in occurrence of problems in that the photosensitivity of the photoreceptor deteriorates, and the residual potential increases. In contrast, when the content is higher than 80% by weight, the content of a radically polymerizable compound having no charge transport structure used for forming the crosslinked material decreases, thereby decreasing the cross-linkage density of the outermost layer, resulting in deterioration of the abrasion resistance of the photoreceptor. The targets of the abrasion resistance and electrostatic properties of the crosslinked outermost layer are determined depending on the image forming processes for which the photoreceptor is used, and therefore the content of the charge transport material in the outermost layer is not unambiguously determined. However, the content is preferably from 35% to 65% by weight in order to balance both the properties.

In the present application, the crosslinked outermost layer is obtained by crosslinking a radically polymerizable tri- or more-functional compound having no charge transport structure. However, the outermost layer can further include thermoplastic resins to relax stress of the crosslinked outermost layer. Suitable materials for use as the thermoplastic resin include known thermoplastic resins.

Specific examples of such thermoplastic resins include polystyrene, styrene-acrylonitrile copolymers, styrene-butadiene copolymers, styrene-maleic anhydride copolymers, polyesters, polyvinyl chloride, vinyl chloride-vinyl acetate copolymers, polyvinyl acetate, polyvinylidene chloride, polyarylates, phenoxy resins, polycarbonates, cellulose acetate resins, ethyl cellulose resins, polyvinyl butyral resins, polyvinyl formal resins, and the like.

When the content of a thermoplastic resin in the outermost layer is too high, the cross-linkage density of the outermost layer decreases, thereby deteriorating the abrasion resistance of the photoreceptor. Therefore, the content of a thermoplastic resin in the outermost layer is preferably not higher than 50 parts by weight, and more preferably not higher than 30 parts by weight, based on 100 parts by weight of radically polymerizable compounds used for forming the crosslinked material.

The crosslinked outermost layer of the photoreceptor of this disclosure preferably includes a crosslinked material which is prepared by crosslinking one or more radically polymerizable compounds having three or more functional groups and no charge transport structure. When the crosslinked outermost layer is prepared, a polymerization initiator can be used if desired, to efficiently perform the crosslinking reaction.

Specific examples of photopolymerization initiators for use in preparing the outermost layer include acetophenone or ketal type photopolymerization initiators such as diethoxyacetophenone, 2,2-dimethoxy-1,2-diphenylethane-1-one, 1-hydroxy-cyclohexyl-phenyl-ketone, 4-(2-hydroxyethoxy) phenyl-(2-hydroxy-2-propyl)ketone, 2-benzyl-2-dimethylamino-1-(4-morpholinophenyl)butanone-1,2-hydroxy-2-methyl-1-phenylpropane-1-one, 2-methyl-2-morpholino(4-methylthiophenyl)propane-1-one, and 1-phenyl-1,2-propanedione-2-(o-ethoxycarbonyl)oxime; benzoin ether type photopolymerization initiators such as benzoin, benzoin methyl ether, benzoin ethyl ether, benzoin isobutyl ether, and benzoin isopropyl ether; benzophenone type photopolymerization initiators such as benzophenone, 4-hydroxybenzophenone, o-benzoylbenzoic acid methyl ester, 2-benzoyl naphthalene, 4-benzoyl biphenyl, 4-benzoyl phenyl ether, acryalted benzophenone, and 1,4-benzoyl benzene; thioxanthone type photopolymerization initiators such as 2-isopropylthioxanthone, 2-chlorothioxanthone, 2,4-dimethylthioxanthone, 2,4-diethylthioxanthone, and 2,4-dichlorothioxanthone; and other photopolymerization initiators such as ethylanthraquinone, 2,4,6-trimethylbenzoyldiphenylphosphineoxide, 2,4,6-trimethylbenzoylphenylethoxyphosphineoxide, bis(2,4,6-trimethylbenzoyl)phenylphosphineoxide, bis(2,4-dimethoxybenzoyl)-2,4,4-trimethylpentylphosphineoxide, methylphenylglyoxyester, 9,10-phenanthrene, acridine compounds, triazine compounds, imidazole compounds, and the like.

In addition, photopolymerization accelerators can also be used alone or in combination with the above-mentioned photopolymerization initiators. Specific examples of the photopolymerization accelerators include triethanolamine, methyldiethanolamine, ethyl 4-dimethylaminobenzoate, isoamyl 4-dimethylaminobenzoate, 2-dimethylaminoethyl benzoate, 4,4'-dimethylaminobenzophenone, and the like.

The added amount of the polymerization initiators is preferably from 0.5 to 40 parts by weight, and more preferably from 1 to 20 parts by weight, per 100 parts by weight of the total weight of the radically polymerizable compounds used.

In order to relax stress of the crosslinked outermost layer and to improve the adhesion of the outermost layer to the photosensitive layer, the outermost layer coating liquid can include additives such as plasticizers, and leveling agent.

Specific examples of the plasticizers include known plasticizers for use in general resins, such as dibutyl phthalate, and dioctyl phthalate. The added amount of the plasticizers in the outermost layer coating liquid is preferably not greater than 20% by weight, and more preferably not greater than 10% by weight, based on the total solid components included in the coating liquid.

Specific examples of the leveling agents include silicone oils (such as dimethylsilicone oils, and methylphenylsilicone oils), and polymers and oligomers having a perfluoroalkyl group in their side chains. The added amount of the leveling agents is preferably not greater than 3% by weight based on the total solid components included in the coating liquid.

In addition, in order to impart good charge transportability to the outermost layer, a low molecular weight charge transport material having no radical reactivity can be included in the outermost layer coating liquid.

The crosslinked outermost layer is typically prepared by coating a coating liquid, which includes at least a radically polymerizable tri- or more-functional compound having no charge transport structure and a charge transport material having formula (1), on the photosensitive layer (or charge transport layer) and then crosslinking the coated layer. When the radically polymerizable compound is liquid, it is possible to dissolve other components (such as the charge transport material and optional additives) in the radically polymerizable compound when preparing the outermost layer coating liquid. The coating liquid can optionally include a solvent to well dissolve the other components and/or to reduce the viscosity of the coating liquid.

Specific examples of such solvents include alcohols such as methanol, ethanol, propanol, and butanol; ketones such as acetone, methyl ethyl ketone, methyl isobutyl ketone, and cyclohexanone; esters such as ethyl acetate, and butyl acetate; ethers such as tetrahydrofuran, dioxane, and propyl ether; halogenated solvents such as dichloromethane, dichloroethane, trichloroethane, and chlorobenzene; aromatic solvents such as benzene, toluene, and xylene; cellosolves such as methyl cellosolve, ethyl cellosolve and cellosolve acetate; and the like. These solvents can be used alone or in combination. The added amount of a solvent is not particularly limited, and is determined depending on the solubility of the components, coating methods, and the target thickness of the outermost layer. Suitable coating methods for use in coating the outermost layer coating liquid include dip coating, spray coating, bead coating, ring coating, and the like.

After the outermost layer coating liquid is coated, light energy is externally applied to the coated layer to form a crosslinked outermost layer.

When the photo-crosslinking treatment is performed, UV light sources such as high pressure mercury lamps and metal halide lamps emitting UV light are preferably used. In this case, depending on the light absorption property of the radically polymerizable compounds and polymerization initiators used, light source emitting visible light can also be used. The crosslinking reaction of radically polymerizable compounds is largely influenced by the temperature thereof, and the temperature of the coated layer is preferably controlled so as to be from 20° C. to 170° C. when irradiating the coated layer with UV light. The method for controlling the temperature of the coated layer is not particularly limited, and any known heat controlling methods using a heat source can be used as long as the methods can control the temperature of the coated layer in the above temperature range.

One example of the methods for preparing the crosslinked outermost layer will be described.

An acrylate monomer having three acryloyloxy groups and a triaryl amine compound having one acryloyloxy group are mixed in a weight ratio of from 3/7 to 7/3. In addition, a polymerization initiator is added to the mixture in an amount of from 3% to 20% by weight based on the acrylate compounds, and a solvent is further added thereto to prepare an outermost layer coating liquid. In this regard, when the charge transport layer, on which the outermost layer coating liquid is applied, is constituted of a triaryl amine donor serving as a charge transport material and a polycarbonate serving as a binder resin and the outermost layer coating liquid is coated by a spray coating method, the solvent used for the outermost layer coating liquid is preferably selected from tetrahydrofuran, 2-butanone, ethyl acetate, and the like. The added amount of the solvent is preferably from 300 parts by weight to 1,000 parts by weight based on 100 parts by weight of the acrylate compounds.

The thus prepared outermost layer coating liquid is coated on a photoreceptor, which is prepared by overlaying an undercoat layer, a charge generation layer and a charge transport layer on an aluminum cylinder serving as an electroconductive substrate, using a spray coating method. After the coated layer is dried to an extent such that the dried layer is not damaged when being contacted with a finger (i.e., the dried layer achieves a dust-free state), the layer is irradiated with UV light to be crosslinked.

In the UV light irradiating process, a metal halide lamp or the like is preferably used. In this regard, the illuminance is preferably from 50 mW/cm$^2$ to 1,000 mW/cm$^2$. When the illuminance is 700 mW/cm$^2$, the coated outermost layer is exposed to UV light for 2 minutes while the aluminum cylinder is rotated, so that any portion of the layer is evenly exposed to the light. In this regard, the temperature of the surface of the outermost layer is controlled so as not to seriously increase.

After the crosslinking treatment, the outermost layer is heated for 10 minutes to 30 minutes at a temperature of from 100° C. to 150° C. to remove the residual solvent from the outermost layer.

The thus prepared outermost layer is preferably insoluble in organic solvents. If the outermost layer is insufficiently crosslinked, the resultant layer is soluble in organic solvents, and has a low cross-linkage density. Therefore, such an insufficiently crosslinked outermost layer has low mechanical durability.

When performing the crosslinking reaction, the oxygen concentration of the crosslinking chamber is preferably controlled to be extremely low to avoid insufficient crosslinking of the outermost layer caused by oxygen (i.e., to accelerate the crosslinking reaction). When light irradiation is performed while rotating the substrate, not only the oxygen concentration of the atmosphere of the irradiated portion of the outermost layer but also the oxygen concentration of the atmosphere of the non-irradiated portion of the outermost layer is controlled so as to be extremely low so that the entire outermost layer has a high cross-linkage density.

In addition, when coating the outermost layer coating liquid using a spray coating method and then drying the coated liquid to an extent such that the coated layer achieves a dust-free state, it is preferable to feed an inert gas such as nitrogen gas into the coating chamber to replace air in the chamber with the inert gas and to reduce the oxygen concentration in the chamber.

The thickness of the crosslinked outermost layer is preferably from 1 μm to 30 μm, more preferably from 2 μm to 20 μm, and even more preferably from 4 μm to 15 μm. When the thickness is less than 1 μm, the layer is easily damaged when carrier particles included in the developer used for developing an electrostatic latent image on the photoreceptor stick in the outermost layer, resulting in shortening of the life of the photoreceptor. In contrast, when the thickness is greater than 30 μm, the residual potential of the photoreceptor tends to increase.

The outermost layer can include a filler. By including a filler in the outermost layer, the abrasion resistance of the layer can be enhanced, thereby prolonging the life of the photoreceptor. In addition, since the surface of the outermost layer is roughened by the filler, a lubricant such as fatty acid metal salts (e.g., zinc stearate and calcium stearate), which is used for enhancing the cleaning property of the photoreceptor and the transferring property of toner images formed on the photoreceptor, can be evenly applied on the surface (outermost layer) of the photoreceptor.

Organic fillers and inorganic fillers can be used as the filler. Specific examples of the organic fillers include powders of fluorine-containing resins such as polytetrafluoroethylene, powders of silicone resins, powders of amorphous carbons, and the like. Specific examples of the inorganic fillers include powders of metals such as copper, tin, aluminum, and indium; powders of metal oxides such as silica, tin oxide, zinc oxide, titanium oxide, alumina, zirconia, indium oxide, antimony oxide, and bismuth oxide; and powders of other inorganic materials such as potassium titanate. These fillers can be used alone or in combination.

Among these fillers, inorganic fillers are preferably used because of having high hardness. Particularly, metal oxides such as silica, alumina, and titanium oxide are more preferably used because of hardly deteriorating the electrostatic property of the photoreceptor. In addition, colloidal silica and colloidal alumina can also be preferably used.

The average primary particle diameter of the filler included in the outermost layer is preferably from 0.01 μm to 0.5 μm so that the resultant outermost layer has a good combination of light transmission property and abrasion resistance. When the average primary particle diameter of the filler is smaller than 0.01 μm, particles of the filler tend to aggregate, resulting in deterioration of the abrasion resistance. In contrast, when the average primary particle diameter is larger than 0.5 μm, the filler tends to precipitate in the coating liquid, resulting in formation uneven outermost layer. In addition, such a large filler tends to cause a toner filming problem in that a toner film is formed on the surface of the photoreceptor, resulting in deterioration of image qualities.

The content of a filler in the outermost layer is preferably as high as possible because of enhancing the abrasion resistance of the photoreceptor. However, when the content is too high, the residual potential of the photoreceptor seriously increases, and the light transmission property of the outermost layer deteriorates, resulting in deterioration of image qualities. Therefore, the content of a filler in the outermost layer is from 5% to 50% by weight, and more preferably from 5% to 30% by weight, based on the total weight of the solid components included in the outermost layer.

The surface of the filler included in the outermost layer is preferably subjected to a treatment to enhance the dispersibility of the filler. When a filler is not well dispersed in the outermost layer, the electrostatic properties of the photoreceptor deteriorate (e.g., the residual potential of the photoreceptor increases) while causing problems such that transparency of the layer decreases, the outermost layer has coating defects, and the abrasion resistance of the photoreceptor deteriorates.

Any known surface treatment agents can be used for treating the surface of fillers, but agents capable of maintaining the insulating property of fillers can be preferably used. Specific examples of such surface treatment agents include titanate coupling agents, aluminum coupling agents, zircoaluminate coupling agents, higher fatty acids (such as aluminum stearate), combinations of these agents with silane coupling agents, silicone oils and resins, $Al_2O_3$, $TiO_2$, $ZrO_2$, and the like. These surface treatment agents can be used alone or in combination. By using such a surface treated filler for the outermost layer, the filler can be well dispersed in the outermost layer, and formation of blurred images can be prevented. When a silane coupling agent is used as a surface treatment agent, blurred images may be produced. However, a combination of a silane coupling agent and one or more of the above-mentioned surface treatment agents is used, formation of blurred images can be often prevented. When treating the surface of a filler with a surface treatment agent, the amount of the surface treatment agent, which is changed depending on the average primary particle diameter of the filler, is preferably from 3% to 30% by weight, and more preferably from 5% to 20% by weight, based on the weight of the filler. When the amount is less than 3%, good filler dispersing effect is hardly produced. In contrast, when the amount is greater than 30%, the residual potential of the photoreceptor tends to increase.

The photoreceptor of the present application can have an intermediate layer between the photosensitive layer 33 (or charge transport layer 37) and the crosslinked outermost layer 39. The intermediate layer includes a resin as a main component. Specific examples of such a resin include polyamide resins, alcohol-soluble nylon resins, water-soluble polyvinyl butyral resins, polyvinyl butyral resins, polyvinyl alcohol resins, and the like. The above-mentioned coating methods are typically used for preparing the intermediate layer. The thickness of the intermediate layer is generally from 0.05 μm to 2 μm.

The photoreceptor of the present application can have an undercoat layer between the electroconductive substrate 31 and the photosensitive layer 33 (or charge generation layer 35). The undercoat layer includes a resin as a main component. Specific examples of such a resin include water-soluble resins such as polyvinyl alcohol resins, casein, and polyacrylic acid sodium salts; alcohol-soluble resins such as nylon copolymers, and methoxymethylated nylon resins; crosslinked resins having a three-dimensional network, such as polyurethane resins, melamine resins, phenolic resins, alkyd-melamine resins, and epoxy resins; and the like.

The undercoat layer can optionally include a fine particulate material to prevent formation of moiré, or to decrease the residual potential of the photoreceptor. Specific examples of such a fine particulate material include metal oxides such as titanium oxide, silica, alumina, zirconium oxide, tin oxide, indium oxide, and the like.

The undercoat layer is typically formed by coating a coating liquid including a resin, an optional particulate material and a proper solvent using a proper coating method.

The undercoat layer may be formed using a silane coupling agent, titanium coupling agent or a chromium coupling agent. In addition, a layer of aluminum oxide which is formed by an anodic oxidation method, and a layer of an organic compound such as polyparaxylylene or an inorganic compound such as $SiO_2$, $SnO_2$, $TiO_2$, ITO or $CeO_2$, which is formed by a vacuum evaporation method, can also be preferably used as the undercoat layer. However, the undercoat layer is not limited thereto, and any known undercoat layers can also be used. The thickness of the undercoat layer is preferably 0 to 5 μm.

In order to improve coating properties of coating liquids for use in preparing the layers of the photoreceptor and stability of the photoreceptor to withstand environmental conditions and to prevent deterioration of photosensitivity and charging properties, and increase of residual potential, the photoreceptor can include additives such as antioxidants, plasticizers, lubricants, ultraviolet absorbing agents, and leveling agents in one or more of the layers of the photoreceptor (e.g., the charge generation layer, charge transport layer, single-layered photosensitive layer, undercoat layer, intermediate layer, and outermost layer).

Suitable antioxidants for use in the layers of the photoreceptor include the following compounds, but are not limited thereto.

(a) Phenolic Compounds 2,6-di-t-butyl-p-cresol, butylated hydroxyanisole, 2,6-di-t-butyl-4-ethylphenol, n-octadecyl-3-(4'-hydroxy-3',5'-di-t-butylphenol), 2,2'-methylene-bis-(4-methyl-6-t-butylphenol), 2,2'-methylene-bis -(4-ethyl-6-t-butylphenol), 4,4'-thiobis-(3-methyl-6-t-butylphenol), 4,4'-butylidenebis-(3-methyl-6-t-butylphenol), 1,1,3-tris-(2-methyl-4-hydroxy-5-t-butylphenyl)butane, 1,3,5-trimethyl-2,4,6-tris(3,5-di-t-butyl-4-hydroxybenzyl)benzene, tetrakis-[methylene-3-(3',5'-di-t-butyl-4'-hydroxyphenyl)propionate]methane, bis[3,3'-bis(4'-hydroxy-3'-t-butylphenyl)butyric acid]glycol ester, tocopherol compounds, and the like.

(b) Paraphenylenediamine Compounds

N-phenyl-N'-isopropyl-p-phenylenediamine, N,N'-di-sec-butyl-p-phenylenediamine, N-phenyl-N-sec-butyl-p-phenylenediamine, N,N'-di-isopropyl-p-phenylenediamine, N,N'-dimethyl-N,N'-di-t-butyl-p-phenylenediamine, and the like.

(c) Hydroquinone Compounds 2,5-di-t-octylhydroquinone, 2,6-didodecylhydroquinone, 2-dodecylhydroquinone, 2-dodecyl-5-chlorohydroquinone, 2-t-octyl-5-methylhydroquinone, 2-(2-octadecenyl)-5-methylhydroquinone, and the like.

(d) Organic Sulfur-Containing Compounds dilauryl-3,3'-thiodipropionate, distearyl-3,3'-thiodipropionate, ditetradecyl-3,3'-thiodipropionate, and the like.

(e) Organic Phosphorus-Containing Compounds triphenylphosphine, tri(nonylphenyl)phosphine, tri(dinonylphenyl)phosphine, tricresylphosphine, tri(2,4-dibutylphenoxy)phosphine, and the like.

Suitable plasticizers for use in the layers of the photoreceptor include the following compounds, but are not limited thereto:

(a) Phosphoric Acid Esters

Triphenyl phosphate, tricresyl phosphate, trioctyl phosphate, octyldiphenyl phosphate, trichloroethyl phosphate, cresyldiphenyl phosphate, tributyl phosphate, tri-2-ethylhexyl phosphate, and the like.

(b) Phthalic Acid Esters

Dimethyl phthalate, diethyl phthalate, diisobutyl phthalate, dibutyl phthalate, diheptyl phthalate, di-2-ethylhexyl phthalate, diisooctyl phthalate, di-n-octyl phthalate, dinonyl phthalate, diisononyl phthalate, diisodecyl phthalate, diundecyl phthalate, ditridecyl phthalate, dicyclohexyl phthalate, butylbenzyl phthalate, butyllauryl phthalate, methyloleyl phthalate, octyldecyl phthalate, dibutyl fumarate, dioctyl fumarate, and the like.

(c) Aromatic Carboxylic Acid Esters

Trioctyl trimellitate, tri-n-octyl trimellitate, octyl oxybenzoate, and the like.

(d) Dibasic Fatty Acid Esters

Dibutyl adipate, di-n-hexyl adipate, di-2-ethylhexyl adipate, di-n-octyl adipate, n-octyl-n-decyl adipate, diisodecyl adipate, dialkyl adipate, dicapryl adipate, di-2-etylhexyl azelate, dimethyl sebacate, diethyl sebacate, dibutyl sebacate, di-n-octyl sebacate, di-2-ethylhexyl sebacate, di-2-ethoxyethyl sebacate, dioctyl succinate, diisodecyl succinate, dioctyl tetrahydrophthalate, di-n-octyl tetrahydrophthalate, and the like.

(e) Fatty Acid Ester Derivatives

Butyl oleate, glycerin monooleate, methyl acetylricinolate, pentaerythritol esters, dipentaerythritol hexaesters, triacetin, tributyrin, and the like.

(f) Oxyacid Esters

Methyl acetylricinolate, butyl acetylricinolate, butylphthalylbutyl glycolate, tributyl acetylcitrate, and the like.

(g) Epoxy Compounds

Epoxydized soybean oil, epoxydized linseed oil, butyl epoxystearate, decyl epoxystearate, octyl epoxystearate, benzyl epoxystearate, dioctyl epoxyhexahydrophthalate, didecyl epoxyhexahydrophthalate, and the like.

(h) Dihydric Alcohol Esters

Diethylene glycol dibenzoate, triethylene glycol di-2-ethylbutyrate, and the like.

(i) Chlorine-Containing Compounds

Chlorinated paraffin, chlorinated diphenyl, methyl esters of chlorinated fatty acids, methyl esters of methoxychlorinated fatty acids, and the like.

(j) Polyester Compounds

Polypropylene adipate, polypropylene sebacate, acetylated polyesters, and the like.

(k) Sulfonic Acid Derivatives p-Toluene sulfonamide, o-toluene sulfonamide, p-toluene sulfoneethylamide, o-toluene sulfoneethylamide, toluene sulfone-N-ethylamide, p-toluene sulfone-N-cyclohexylamide, and the like.

(l) Citric Acid Derivatives

Triethyl citrate, triethyl acetylcitrate, tributyl citrate, tributyl acetylcitrate, tri-2-ethylhexyl acetylcitrate, n-octyldecyl acetylcitrate, and the like.

(m) Other compounds

Terphenyl, partially hydrated terphenyl, camphor, 2-nitro diphenyl, dinonyl naphthalene, methyl abietate, and the like.

Suitable lubricants for use in the layers of the photoreceptor include the following compounds, but are not limited thereto.

(a) Hydrocarbons

Liquid paraffins, paraffin waxes, micro waxes, low molecular weight polyethylenes, and the like.

(b) Fatty Acids

Laurie acid, myristic acid, palmitic acid, stearic acid, arachidic acid, behenic acid, and the like.

(c) Fatty Acid Amides

Stearic acid amide, palmitic acid amide, oleic acid amide, methylenebisstearamide, ethylenebisstearamide, and the like.

(d) Ester Compounds

Lower alcohol esters of fatty acids, polyhydric alcohol esters of fatty acids, polyglycol esters of fatty acids, and the like.

(e) Alcohols

Cetyl alcohol, stearyl alcohol, ethylene glycol, polyethylene glycol, polyglycerol, and the like.

(f) Metallic Soaps

Lead stearate, cadmium stearate, barium stearate, calcium stearate, zinc stearate, magnesium stearate, and the like.

(g) Natural Waxes

Carnauba wax, candelilla wax, beeswax, spermaceti, insect wax, montan wax, and the like.

(h) Other Compounds

Silicone compounds, fluorine compounds, and the like.

Suitable ultraviolet absorbing agents for use in the layers of the photoreceptor include the following compounds, but are not limited thereto.

(a) Benzophenone Compounds

2-Hydroxybenzophenone, 2,4-dihydroxybenzophenone, 2,2',4-trihydroxybenzophenone, 2,2',4,4'-tetrahydroxybenzophenone, 2,2'-dihydroxy-4-methoxybenzophenone, and the like.

(b) Salicylate Compounds

Phenyl salicylate, 2,4-di-t-butylphenyl-3,5-di-t-butyl-4-hydroxybenzoate, and the like.

(c) Benzotriazole Compounds (2'-Hydroxyphenyl)benzotriazole, (2'-hydroxy-5'-methylphenyl)benzotriazole, (2'-hydroxy-3'-t-butyl-5'-methylphenyl)-5-chlorobenzotriazole, and the like.

(d) Cyano Acrylate Compounds

Ethyl-2-cyano-3,3-diphenyl acrylate, methyl-2-carbomethoxy-3-(paramethoxy) acrylate, and the like.

(e) Quenchers (Metal Complexes)

Nickel(2,2'-thiobis(4-t-octyl)phenolate)-n-butylamine, nickeldibutyldithiocarbamate, cobaltdicyclohexyldithiophosphate, and the like.

(f) HALS (Hindered Amines)

Bis(2,2,6,6-tetramethyl-4-piperidyl)sebacate, bis(1,2,2,6,6-pentamethyl-4-piperidyl)sebacate, 1-[2-{3-(3,5-di-t-butyl-4-hydroxyphenyl)propionyloxy}ethyl]-4-{3-(3,5-di-t-butyl-4-hydroxy phenyl)propionyloxy}-2,2,6,6-tetramethylpyridine, 8-benzyl-7,7,9,9-tetramethyl-3-octyl-1,3,8-triazaspiro[4,5]undecane-2,4-dione, 4-benzoyloxy-2,2,6,6-tetramethylpiperidine, and the like.

Next, the image forming apparatus and process cartridge of this disclosure will be described.

Figure 4:
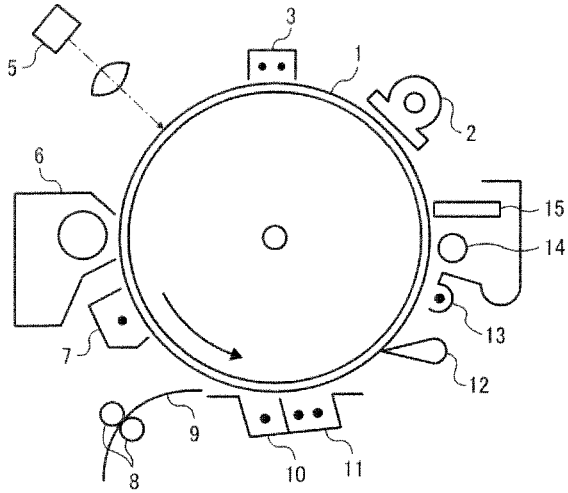
FIG. 4 is a schematic view illustrating the image forming section of an example of the image forming apparatus of this disclosure.

FIG. 4 illustrates the image forming section of an example of the image forming apparatus of this disclosure.

Referring to FIG. 4, the image forming section includes a photoreceptor 1 which serves as an image bearing member and which is the above-mentioned photoreceptor of this disclosure, a charger 3 to charge the surface of the photoreceptor 1, an irradiator 5 to irradiate the charged photoreceptor with light to form an electrostatic latent image on the photoreceptor 1, a developing device 6 to develop the electrostatic latent image with a developer including a toner to form a toner image on the photoreceptor 1, a transferring device to transfer the toner image onto a recording material 9 using a transfer charger 10 while separating the recording material from the photoreceptor 1 using a separation charger 11, a cleaning device to clean the surface of the photoreceptor 1 after transferring the toner image using a fur brush 14 and a blade 15, and a discharger 2 to decay residual charges remaining on the surface of the photoreceptor after cleaning the surface. Reference numerals 8 and 12 respectively denote a pair of registration rollers to timely feed the recording material 9 to the transfer device 10 and 11, and a separation pick to separate the recording material 9 from the photoreceptor 1. Reference numeral 13 denotes a pre-cleaning charger to previously charge the photoreceptor 1 so that the surface of the photoreceptor 1 can be well cleaned with the cleaning device 14 and 15. Reference numeral 7 denotes a pre-transfer charger to previously charge the photoreceptor 1 so that the toner image can be well transferred onto the recording material 9.

The photoreceptor 1 has a drum form, but sheet-form or endless-belt-form photoreceptors can also be used in this disclosure.

Suitable chargers for use as the charger 3 include known chargers capable of uniformly charging the photoreceptor, such as corotrons, scorotrons, solid state dischargers, needle electrodes, charging rollers, electroconductive brushes, and the like. Among these chargers, contact and non-contact short-range chargers are preferably used to prevent occurrence of discharging between the charger 3 and the photoreceptor 1, which tends to decompose the components constituting the layers of the photoreceptor 1. In this regard, the short-range chargers are such that a charging member such as charging rollers is arranged in the vicinity of a photoreceptor while forming a gap of not greater than 200 μm therebetween to charge the photoreceptor. When the gap is too large, the photoreceptor is unstably charged. In contrast, when the gap is too small, it is possible that the charging member is contaminated with toner particles remaining on the surface of the photoreceptor. Therefore, the gap is preferably from 10 μm to 200 μm, and more preferably from 10 μm to 100 μm. It is more effective to use the photoreceptor of this disclosure for such contact or short-range chargers because the photoreceptor is hardly deteriorated by short-range discharging caused by the chargers.

The irradiator 4 has a light source to irradiate the charged photoreceptor 1 with light. Suitable light sources for use in the irradiator 5 include fluorescent lamps, tungsten lamps, halogen lamps, mercury lamps, sodium lamps, light emitting diodes (LEDs), laser diodes (LDs), light sources using electroluminescence (EL), and the like. In addition, in order to obtain light having a desired wave length range, filters such as sharp-cut filters, band pass filters, near-infrared cutting filters, dichroic filters, interference filters, color temperature converting filters and the like can be used.

The developing device 6 develops the electrostatic latent image on the photoreceptor 1 with a developer including a toner. Suitable developing methods include dry developing methods (such as one component developing methods using a toner as a one-component developer and two component developing methods using a two-component developer including a carrier and a toner), and wet developing methods.

When the photoreceptor 1, which is previously charged positively (or negatively), is exposed to imagewise light, an electrostatic latent image having a positive (or negative) charge is formed on the photoreceptor 1. When the latent image having a positive (or negative) charge is developed with a toner having a negative (or positive) charge, a positive image can be obtained. In contrast, when the latent image having a positive (negative) charge is developed with a toner having a positive (negative) charge, a negative image (i.e., a reversal image) can be obtained.

The toner image formed on the photoreceptor 1 is transferred to the recording material 9 by the transfer charger 10. In order to well perform the transfer operation, the pre-transfer charger 7 can be used. Suitable transfer methods include transfer methods using a transfer charger, electrostatic transfer methods using a bias roller, mechanical transfer methods such as adhesion transfer methods and pressure transfer methods, magnetic transfer methods, and the like. The above-mentioned chargers can be preferably used for the electrostatic transfer methods.

The recording material 9, on which the toner image has been transferred, is separated from the photoreceptor 1 by the separation charger 11 and the separation pick 12. Other separation methods such as separation methods utilizing electrostatic attraction, separation methods using a belt end, separation methods including griping tip of a recording material, separation methods utilizing curvature, and the like can also be used. The above-mentioned chargers can be used for the separation charger 11.

The recording material 9 bearing a toner image is then fed to a fixing device to fix the toner image onto the recording material. Known fixing devices such as fixing devices using a heat roller and a pressure roller, and fixing devices using a fixing belt, a heat roller and a pressure roller can be used.

When the toner image formed on the photoreceptor 1 by the developing device 6 is transferred onto the recording material 9, the entire toner image is not transferred onto the recording material 9, and toner particles remain on the surface of the photoreceptor 1. The residual toner is removed from the photoreceptor 1 by the fur brush 14 and cleaning blade 15. In order to well clean the surface of the photoreceptor 1, the pre-cleaning charger 13 can be used. Other cleaning methods such as web cleaning methods and magnet brush cleaning methods can also be used. These cleaning methods can be used alone or in combination.

Suitable devices for use as the discharging device 2 include discharging lamps and discharging chargers. The lamps mentioned above for use in the light irradiator and the chargers mentioned above for use in the charger 3 can be used for the discharging device 2.

The image forming apparatus of this disclosure can further include a document reader to read the image of an original image with an image reader; a feeding device to feed the recording material 9 toward the photoreceptor 1; and a copy discharging device to discharge the recording material 9 bearing a fixed image thereon (i.e., a copy) from the image forming apparatus. Known document readers, feeding devices, copy discharging devices, can be used for the image forming apparatus of this disclosure.

The image forming section illustrated in FIG. 4 can be fixedly set in an image forming apparatus such as copiers, facsimiles and printers. However, the image forming section can be detachably attached to an image forming apparatus as a process cartridge.

Figure 5:
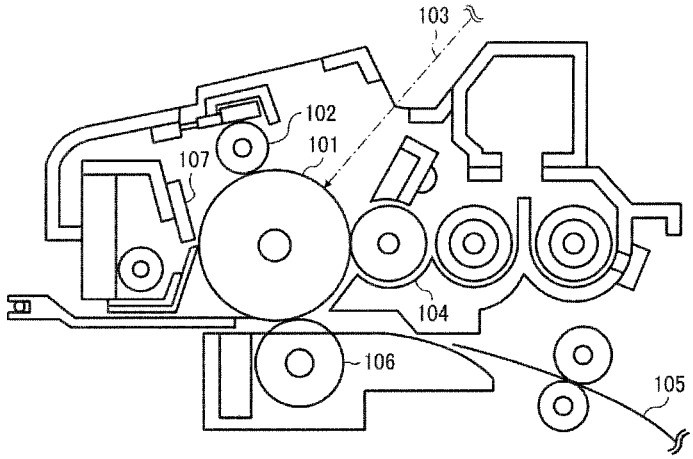
FIG. 5 is a schematic view illustrating an example of the process cartridge of this disclosure.

FIG. 5 illustrates an example of the process cartridge of this disclosure, and a photoreceptor 101 is the photoreceptor of this disclosure.

Around the photoreceptor 101, a charger 102 (a charging roller) to charge the photoreceptor 101 which rotates in a direction indicated by an arrow; a light beam 103 (emitted by a light irradiator (not shown) of an image forming apparatus) irradiating the photoreceptor 101 to form an electrostatic latent image thereon; a developing device (developing roller) 104 to develop the latent image with a developer including a toner to form a toner image on the photoreceptor 101; a transferring device 106 to transfer the toner image onto a recording material 105; and a cleaner including a blade 107 to clean the surface of the photoreceptor 101, are arranged. The photoreceptor 101 may be subjected to a discharging process in which residual charges remaining on the photoreceptor 101 even after the transfer process are decayed with a discharging device (not shown).

The process cartridge illustrated in FIG. 5 is detachably attached to an image forming apparatus as a single unit. The process cartridge includes the photoreceptor 101 and at least one of a charger, a developing device, a transfer device, a cleaner and a discharger.

Having generally described this invention, further understanding can be obtained by reference to certain specific examples which are provided herein for the purpose of illustration only and are not intended to be limiting. In the descriptions in the following examples, the numbers represent weight ratios in parts, unless otherwise specified.

EXAMPLES

Example 1

1. Preparation of Undercoat Layer

The following components were mixed and the mixture was subjected to a dispersing treatment to prepare an undercoat layer coating liquid.

| | |
|---|---|
| Titanium dioxide (TIPAQUE CR-EL from Ishihara Sangyo Kaisha K.K.) | 400 parts |
| Melamine resin (SUPER BECKAMINE G-821-60 from Dainippon Ink And Chemicals, Inc.) | 65 parts |
| Alkyd resin (BECKOLITE M6401-50 from Dainippon Ink And Chemicals, Inc.) | 120 parts |
| 2-Butanone | 400 parts |

The undercoat layer coating liquid was coated on an aluminum cylinder by a dip coating method, and the coated liquid was dried. Thus, an undercoat layer having a thickness of about 3.5 nm was prepared.

2. Preparation of Charge Generation Layer

The following components were mixed, and the mixture was subjected to a dispersing treatment to prepare a charge generation layer coating liquid.

Figure 3:
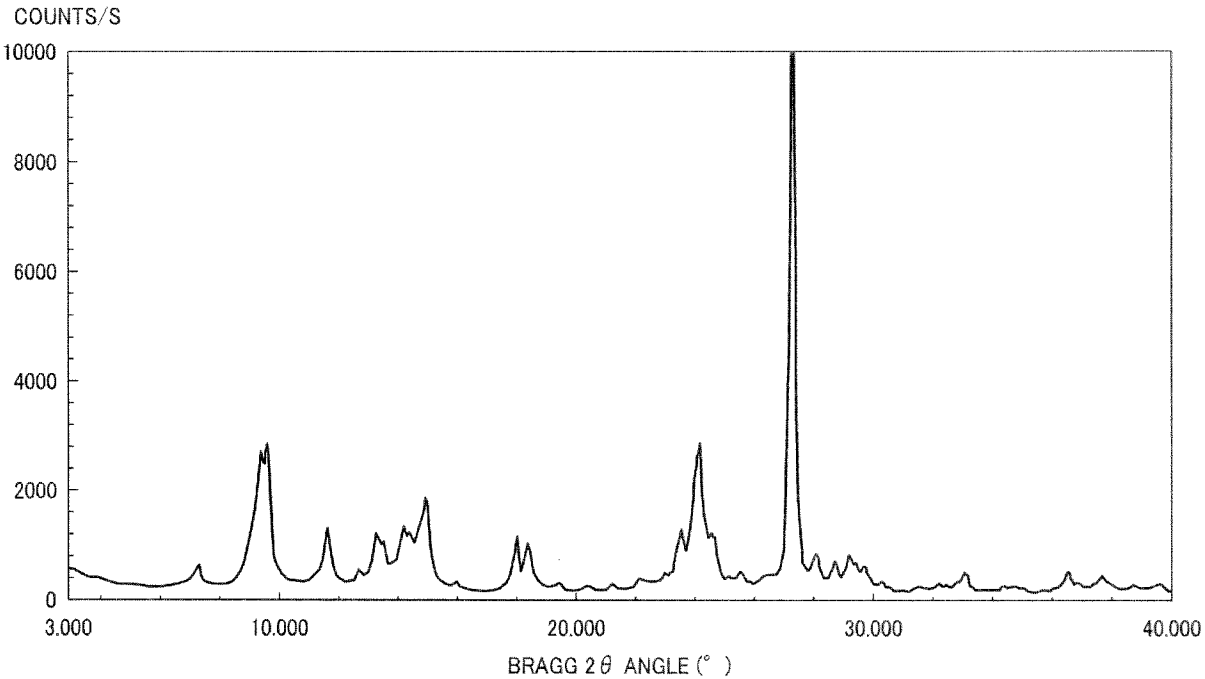
FIG. 3 is an X-ray diffraction spectrum of a titanyl phthalocyanine used for the photoreceptor of Example 1.

| | |
|---|---|
| Titanyl phthalocyanine (having an X-ray diffraction spectrum illustrated in FIG. 3) | 8 parts |
| Polyvinyl butyral (S-LEC BX-1 from Sekisui Chemical Co., Ltd.) | 5 parts |
| 2-Butanone | 400 parts |

The charge generation layer coating liquid was coated on the undercoat layer by a dip coating method, and the coated liquid was dried. Thus, a charge generation layer having a thickness of about 0.2 nm was prepared.

3. Preparation of Charge Transport Layer

The following components were mixed to prepare a charge transport layer coating liquid.

| | |
|---|---|
| Z-form polycarbonate (from Teijin Chemicals Ltd.) | 10 parts |
| Charge transport material having the following formula A | 9 parts |

(A)

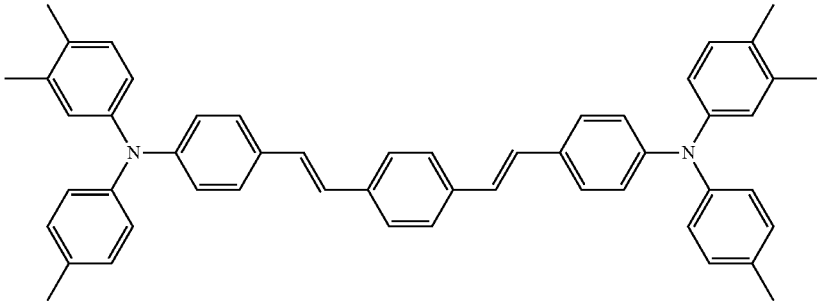

| | |
|---|---|
| Tetrahydrofuran | 100 parts |

The charge transport layer coating liquid was coated on the charge generation layer by a dip coating method, and the coated liquid was dried. Thus, a charge transport layer having a thickness of about 23 nm was prepared.

4. Preparation of Crosslinked Outermost Layer

The following components were mixed to prepare an outermost layer coating liquid.

| | |
|---|---|
| Trimethylolpropane triacrylate (KAYARAD TMPTA from Nippon Kayaku Co., Ltd., serving as polymerizable compound having no charge transport structure, molecular weight (MW) of 296, number (N) of functional groups of 3, and ratio (MW/N) of 99) | 8 parts |
| Non-crosslinkable carbazole compound serving as charge transport material (compound No. 10 having the following formula) | 10 parts |
| NO. 10 | |
| 1-hydroxycyclohexyl phenyl ketone serving as photopolymerization initiator (IRGACURE 184 from Ciba Specialty Chemicals) | 0.5 parts |
| Particulate alumina (AA-05 from Sumitomo Chemical Co., Ltd., having a primary particle diameter of 0.5 μm) | 2 parts |
| Z-form polycarbonate serving as thermoplastic binder resin (from Teijin Chemicals Ltd.) | 2 parts |
| Tetrahydrofuran | 100 parts |

Figure 6:
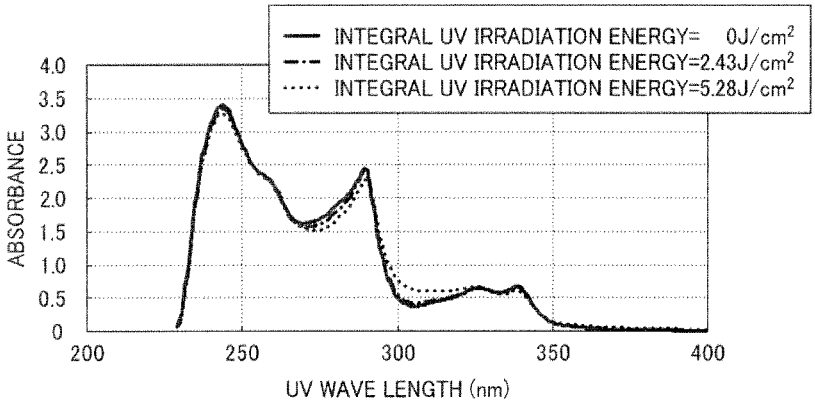
FIG. 6 illustrates absorbance spectra of a charge transport material used for Example 1 before and after the charge transport material is irradiated with UV rays.

The absorbance spectra of the charge transport material (i.e., compound No. 10) before and after irradiation of UV rays are illustrated in FIG. 6. It is clear from FIG. 6 that the absorbance spectrum of the charge transport material hardly changes even after the material is irradiated with UV rays.

The outermost layer coating liquid was coated on the charge transport layer by a spray coating method, and the coated liquid was exposed to UV light, followed by heating for 30 minutes at 130° C. to be crosslinked. Thus, a crosslinked outermost layer having a thickness of 5 μm was prepared.

Thus, a photoreceptor of Example 1 was prepared.

Example 2

The procedure for preparation of the photoreceptor of Example 1 was repeated except that the thermoplastic resin (Z-form polycarbonate) in the outermost layer coating liquid was replaced with a thermoplastic resin TW-257 from ADEKA Corporation.

Thus, a photoreceptor of Example 2 was prepared.

Example 3

The procedure for preparation of the photoreceptor of Example 1 was repeated except that the amount of the thermoplastic resin (Z-form polycarbonate) in the outermost layer coating liquid was changed from 2 parts to 0.1 parts.

Thus, a photoreceptor of Example 3 was prepared.

Example 4

The procedure for preparation of the photoreceptor of Example 1 was repeated except that the amount of the thermoplastic resin (Z-form polycarbonate) in the outermost layer coating liquid was changed from 2 parts to 8 parts.

Thus, a photoreceptor of Example 4 was prepared.

Example 5

The procedure for preparation of the photoreceptor of Example 1 was repeated except that the amount of the thermoplastic resin (Z-form polycarbonate) in the outermost layer coating liquid was changed from 2 parts to 10 parts.

Thus, a photoreceptor of Example 5 was prepared.

Example 6

The procedure for preparation of the photoreceptor of Example 1 was repeated except that the formula of the outermost layer coating liquid was changed the following.

| | |
|---|---|
| Trimethylolpropane triacrylate (KAYARAD TMPTA from Nippon Kayaku Co., Ltd.) | 10 parts |
| Non-crosslinkable carbazole compound serving as charge transport material (compound No. 10 described above) | 10 parts |
| 1-hydroxycyclohexyl phenyl ketone serving as photopolymerization initiator (IRGACURE 184 from Ciba Specialty Chemicals) | 0.5 parts |
| Particulate alumina (AA-05 from Sumitomo Chemical Co., Ltd.) | 0.2 parts |
| Tetrahydrofuran | 100 parts |

Thus, a photoreceptor of Example 6 was prepared.

Example 7

The procedure for preparation of the photoreceptor of Example 6 was repeated except that the particulate alumina AA-05 in the outermost layer coating liquid was replaced with a particulate alumina AA-03 from Sumitomo Chemical Co., Ltd., which has a primary particle diameter of 0.3 μm Thus, a photoreceptor of Example 7 was prepared.

Example 8

The procedure for preparation of the photoreceptor of Example 6 was repeated except that the particulate alumina AA-05 in the outermost layer coating liquid was replaced with a particulate titanium oxide CR97 from Ishihara Sangyo Kaisha K.K.

Thus, a photoreceptor of Example 8 was prepared.

Example 9

The procedure for preparation of the photoreceptor of Example 6 was repeated except that the particulate alumina AA-05 in the outermost layer coating liquid was replaced with a particulate fluorine-containing resin, MPE-056 from Du Pont-Mitsui Fluorochemicals Co., Ltd.

Thus, a photoreceptor of Example 9 was prepared.

Example 10

The procedure for preparation of the photoreceptor of Example 6 was repeated except that the particulate alumina AA-05 in the outermost layer coating liquid was replaced with fullerene from Tokyo Kasei Kogyo Co., Ltd.

Thus, a photoreceptor of Example 10 was prepared.

Example 11

The procedure for preparation of the photoreceptor of Example 6 was repeated except that the amount of the particulate alumina AA-05 in the outermost layer coating liquid was changed from 0.2 parts to 1 part.

Thus, a photoreceptor of Example 11 was prepared.

Example 12

The procedure for preparation of the photoreceptor of Example 6 was repeated except that the amount of the particulate alumina AA-05 in the outermost layer coating liquid was changed from 0.2 parts to 2 parts.

Thus, a photoreceptor of Example 12 was prepared.

Example 13

The procedure for preparation of the photoreceptor of Example 6 was repeated except that the amount of the particulate alumina AA-05 in the outermost layer coating liquid was changed from 0.2 parts to 4 parts.

Thus, a photoreceptor of Example 13 was prepared.

Example 14

The procedure for preparation of the photoreceptor of Example 6 was repeated except that the amount of the particulate alumina AA-05 in the outermost layer coating liquid was changed from 0.2 parts to 6 parts.

Thus, a photoreceptor of Example 14 was prepared.

Example 15

The procedure for preparation of the photoreceptor of Example 1 was repeated except that the formula of the outermost layer coating liquid was changed the following.

| | |
|---|---|
| Trimethylolpropane triacrylate (KAYARAD TMPTA from Nippon Kayaku Co., Ltd.) | 10 parts |
| Non-crosslinkable carbazole compound serving as charge transport material (compound No. 10 described above) | 10 parts |
| 1-hydroxycyclohexyl phenyl ketone serving as photopolymerization initiator (, IRGACURE 184 from Ciba Specialty Chemicals) | 0.5 parts |
| Tetrahydrofuran | 100 parts |

Thus, a photoreceptor of Example 15 was prepared.

Example 16

The procedure for preparation of the photoreceptor of Example 15 was repeated except that the amount of the charge transport compound No. 10 in the outermost layer coating liquid was changed from 10 parts to 2 parts.

Thus, a photoreceptor of Example 16 was prepared.

Example 17

The procedure for preparation of the photoreceptor of Example 15 was repeated except that the amount of the charge transport compound No. 10 in the outermost layer coating liquid was changed from 10 parts to 6 parts.

Thus, a photoreceptor of Example 17 was prepared.

Example 18

The procedure for preparation of the photoreceptor of Example 15 was repeated except that the amount of the charge transport compound No. 10 in the outermost layer coating liquid was changed from 10 parts to 14 parts.

Thus, a photoreceptor of Example 18 was prepared.

Example 19

The procedure for preparation of the photoreceptor of Example 15 was repeated except that the amount of the charge transport compound No. 10 in the outermost layer coating liquid was changed from 10 parts to 20 parts.

Thus, a photoreceptor of Example 19 was prepared.

Example 20

The procedure for preparation of the photoreceptor of Example 15 was repeated except that the amount of the charge transport compound No. 10 in the outermost layer coating liquid was changed from 10 parts to 1 part.

Thus, a photoreceptor of Example 20 was prepared.

Example 21

The procedure for preparation of the photoreceptor of Example 15 was repeated except that the amount of the charge transport compound No. 10 in the outermost layer coating liquid was changed from 10 parts to 22 parts.

Thus, a photoreceptor of Example 21 was prepared.

Example 22

The procedure for preparation of the photoreceptor of Example 21 was repeated except that trimethylolpropane triacrylate (KAYARAD TMPTA) in the outermost layer coating liquid was replaced with caprolactone-modified dipentaerythritol hexaacrylate (KAYARAD DPCA-120 from Nippon Kayaku Co., Ltd., serving as polymerizable compound having no charge transport structure, molecular weight (MW) of 1,947, number (N) of functional groups of 6, and ratio (MW/N) of 325).

Thus, a photoreceptor of Example 22 was prepared.

Example 23

The procedure for preparation of the photoreceptor of Example 21 was repeated except that trimethylolpropane triacrylate (KAYARAD TMPTA) in the outermost layer coating liquid was replaced with caprolactone-modified dipentaerythritol hexaacrylate (KAYARAD DPCA-120 from Nippon Kayaku Co., Ltd., serving as polymerizable compound having no charge transport structure, molecular weight (MW) of 1,263, number (N) of functional groups of 6, and ratio (MW/N) of 211).

Thus, a photoreceptor of Example 23 was prepared.

Example 24

The procedure for preparation of the photoreceptor of Example 21 was repeated except that trimethylolpropane triacrylate (KAYARAD TMPTA) in the outermost layer coating liquid was replaced with 1,6-hexanedioldiacrylate (from Wako Pure Chemical Industries, Ltd., serving as polymerizable compound having no charge transport structure, molecular weight (MW) of 226, number (N) of functional groups of 2, and ratio (MW/N) of 113).

Thus, a photoreceptor of Example 24 was prepared.

Example 25

The procedure for preparation of the photoreceptor of Example 24 was repeated except that the charge transport compound No. 10 in the outermost layer coating liquid was replaced with the charge transport compound No. 22 described in Table 1-3.

Thus, a photoreceptor of Example 25 was prepared.

Example 26

The procedure for preparation of the photoreceptor of Example 24 was repeated except that the charge transport compound No. 10 in the outermost layer coating liquid was replaced with the charge transport compound No. 24 described in Table 1-3.

Thus, a photoreceptor of Example 26 was prepared.

Example 27

The procedure for preparation of the photoreceptor of Example 24 was repeated except that the charge transport compound No. 10 in the outermost layer coating liquid was replaced with the charge transport compound No. 16 described in Table 1-2.

Thus, a photoreceptor of Example 27 was prepared.

Example 28

The procedure for preparation of the photoreceptor of Example 24 was repeated except that the charge transport compound No. 10 in the outermost layer coating liquid was replaced with the charge transport compound No. 7 described in Table 1-1.

Thus, a photoreceptor of Example 28 was prepared.

Example 29

The procedure for preparation of the photoreceptor of Example 1 was repeated except that the formula of the outermost layer coating liquid was changed the following.

| | |
|---|---|
| Trimethylolpropane triacrylate (KAYARAD TMPTA from Nippon Kayaku Co., Ltd.) | 5 parts |
| Caprolactone-modified dipentaerythritol hexaacrylate (KAYARAD DPCA-120 from Nippon Kayaku Co., Ltd.) | 5 parts |
| Non-crosslinkable carbazole compound serving as charge transport material (compound No. 7 described above) | 10 parts |
| 1-hydroxycyclohexyl phenyl ketone serving as photopolymerization initiator (IRGACURE 184 from Ciba Specialty Chemicals) | 0.5 parts |
| Particulate alumina serving as filler (AA-03 from Sumitomo Chemical Co., Ltd.) | 0.1 parts |
| Tetrahydrofuran | 100 parts |

Thus, a photoreceptor of Example 29 was prepared.

Example 30

The procedure for preparation of the photoreceptor of Example 29 was repeated except that the charge transport compound No. 7 in the outermost layer coating liquid was replaced with the charge transport compound No. 10 described in Table 1-2.

Thus, a photoreceptor of Example 30 was prepared.

Example 31

The procedure for preparation of the photoreceptor of Example 29 was repeated except that the charge transport compound No. 7 in the outermost layer coating liquid was replaced with the charge transport compound No. 14 described in Table 1-2.

Thus, a photoreceptor of Example 31 was prepared.

Example 32

The procedure for preparation of the photoreceptor of Example 29 was repeated except that the charge transport compound No. 7 in the outermost layer coating liquid was replaced with the charge transport compound No. 15 described in Table 1-2.

Thus, a photoreceptor of Example 32 was prepared.

Example 33

The procedure for preparation of the photoreceptor of Example 29 was repeated except that the charge transport compound No. 7 in the outermost layer coating liquid was replaced with the charge transport compound No. 16 described in Table 1-2.

Thus, a photoreceptor of Example 33 was prepared.

Example 34

The procedure for preparation of the photoreceptor of Example 29 was repeated except that the charge transport compound No. 7 in the outermost layer coating liquid was replaced with the charge transport compound No. 19 described in Table 1-3.

Thus, a photoreceptor of Example 34 was prepared.

Example 35

The procedure for preparation of the photoreceptor of Example 29 was repeated except that the charge transport compound No. 7 in the outermost layer coating liquid was replaced with the charge transport compound No. 20 described in Table 1-3.

Thus, a photoreceptor of Example 35 was prepared.

Example 36

The procedure for preparation of the photoreceptor of Example 29 was repeated except that the charge transport compound No. 7 in the outermost layer coating liquid was replaced with the charge transport compound No. 21 described in Table 1-3.

Thus, a photoreceptor of Example 36 was prepared.

Example 37

The procedure for preparation of the photoreceptor of Example 29 was repeated except that the charge transport compound No. 7 in the outermost layer coating liquid was replaced with the charge transport compound No. 22 described in Table 1-3.

Thus, a photoreceptor of Example 37 was prepared.

Example 38

The procedure for preparation of the photoreceptor of Example 29 was repeated except that the charge transport compound No. 7 in the outermost layer coating liquid was replaced with the charge transport compound No. 24 described in Table 1-3.

Thus, a photoreceptor of Example 38 was prepared.

Comparative Example 1

The procedure for preparation of the photoreceptor of Example 15 was repeated except that the charge transport material No. 10 in the outermost layer coating liquid was replaced with a charge transport compound having the following formula 101.

101

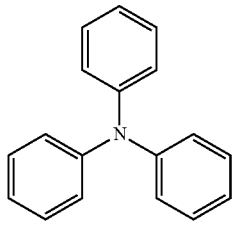

Figure 7:
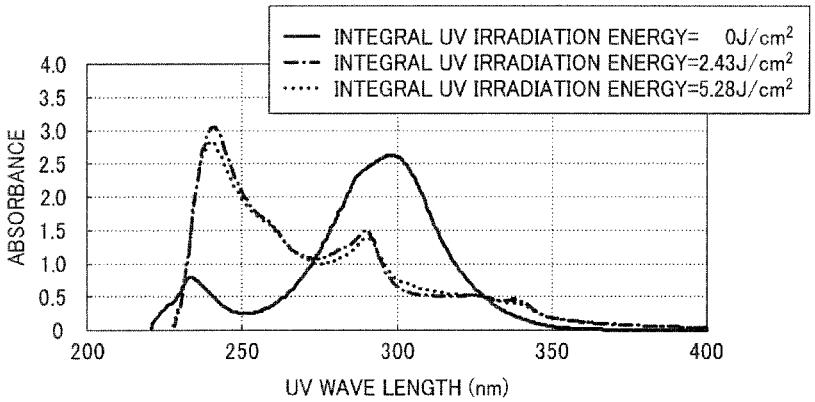
FIG. 7 illustrates absorbance spectra of a charge transport material used for Comparative Example 1 before and after the charge transport material is irradiated with UV rays.

The absorbance spectra of the charge transport material (i.e., compound No. 101) before and after irradiation of UV rays are illustrated in FIG. 7. It is clear from FIG. 7 that the absorbance spectrum of the charge transport material (compound No. 101) considerably changes after the material is irradiated with UV rays.

Thus, a photoreceptor of Comparative Example 1 was prepared.

Comparative Example 2

The procedure for preparation of the photoreceptor of Example 15 was repeated except that the charge transport compound No. 10 in the outermost layer coating liquid was replaced with a charge transport compound having the following formula 102.

102

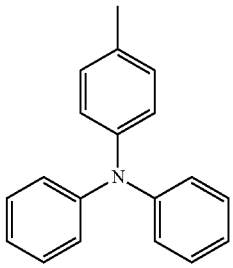

Thus, a photoreceptor of Comparative Example 2 was prepared.

Comparative Example 3

The procedure for preparation of the photoreceptor of Example 15 was repeated except that the charge transport compound No. 10 in the outermost layer coating liquid was replaced with a charge transport compound having the following formula 103.

103

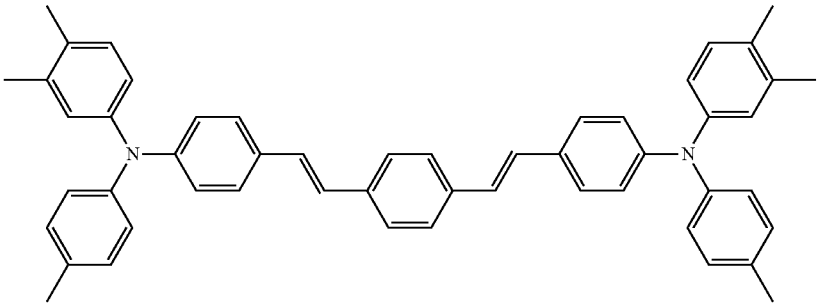

Thus, a photoreceptor of Comparative Example 3 was prepared.

Comparative Example 4

The procedure for preparation of the photoreceptor of Example 15 was repeated except that the charge transport compound No. 10 in the outermost layer coating liquid was replaced with a charge transport compound having the following formula 104.

104

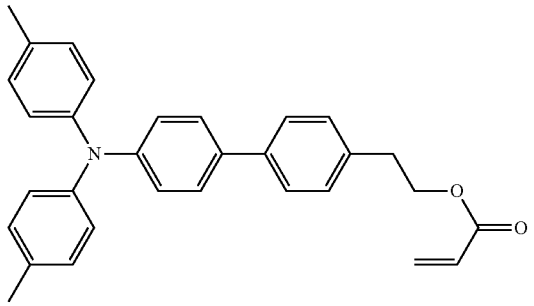

Thus, a photoreceptor of Comparative Example 4 was prepared.

Comparative Example 5

The procedure for preparation of the photoreceptor of Example 15 was repeated except that the charge transport compound No. 10 in the outermost layer coating liquid was replaced with a charge transport polymer having the following formula 105, which is a carbazole compound but is not a carbazole compound for use in the outermost layer because of being a polymer.

105

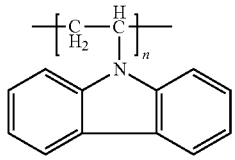

Thus, a photoreceptor of Comparative Example 5 was prepared.

Comparative Example 6

The procedure for preparation of the photoreceptor of Example 1 was repeated except that the crosslinked outermost layer was not formed, and the thickness of the charge transport layer was changed from 23 μm to 28 μm.

Thus, a photoreceptor of Comparative Example 6 was prepared.

Comparative Example 7

The procedure for preparation of the photoreceptor of Example 15 was repeated except that the charge transport compound No. 10 in the outermost layer coating liquid was replaced with a charge transport compound having the following formula 106, which is a carbazole compound but is not a carbazole compound for use in the outermost layer because the R1 group has a reactive substituent.

106

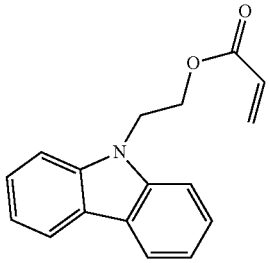

Thus, a photoreceptor of Comparative Example 7 was prepared.

Each of the thus prepared photoreceptors of Examples 1-38 and Comparative Examples 1-7 was evaluated as follows.

Specifically, a process cartridge to which the photoreceptor is attached was set in a tandem full color digital image forming apparatus, a modified version of IMAGIO MPC7500 from Ricoh Co., Ltd., and a running test, in which 100,000 copies of an original character image having an image area proportion of 5% are produced, was performed. At the beginning, and the end (after 100,000 copies were produced) of the running test, the potential VL of an irradiated portion of the photoreceptor, and the job-to-job variation of the potential VL were measured, and the quality of the produced images was visually evaluated. In addition, the photoreceptor was subjected to a mechanical durability evaluation. Further, as for the photoreceptors of Examples 29-38, the running test was continued until 200,000 copies were produced.

The job-to-job variation of the potential VL was measured by the following method.

An image forming operation, in which 50 copies of the original image are continuously produced, was repeated 10 times to determine the job-to-job variation of the potential VL, which is the difference |VL1−VL2| between an initial potential VL1 of an irradiated portion of the photoreceptor at the beginning of the image forming operation and a potential VL2 of the irradiated portion of the photoreceptor at the end of the image forming operation.

The job-to-job variation of the potential VL is graded as follows.

◎: The job-to-job potential variation of the photoreceptor is less than 20V, and is without problems.

○: The job-to-job potential variation of the photoreceptor is not less than 20V and less than 35V, and is on such an acceptable level (i.e., the variation is correctable).

Δ: The job-to-job potential variation of the photoreceptor is not less than 35V and less than 40V, and is on a slightly unacceptable level.

X: The job-to-job potential variation of the photoreceptor is not less than 40V, and is on an unacceptable level.

The mechanical durability evaluation of the photoreceptor was performed as follows. After 100,000 copies were produced, the total thickness of the layers of each photoreceptor was measured to determine abrasion loss. In addition, the surface of each photoreceptor was visually observed to determine whether the surface has scratches.

The evaluation results are shown in Tables 2-1 and 2-2 below.

TABLE 2-1

| | At the beginning of running test | | | After 100,000 copies were produced | | | |
|---|---|---|---|---|---|---|---|
| | VL (−V) | Job-to-job variation of VL (V) | Image quality | VL (−V) | Job-to-job variation of VL (V) | Image quality | Mechanical durability |
| Ex. 1 | 90 | 12 (◎) | Good | 101 | 11 (◎) | Good | Good |
| Ex. 2 | 91 | 14 (◎) | Good | 105 | 16 (◎) | Good | Good |
| Ex. 3 | 90 | 16 (◎) | Good | 110 | 17 (◎) | Good | Good |
| Ex. 4 | 91 | 15 (◎) | Good | 107 | 16 (◎) | Good | Minor scratches |
| Ex. 5 | 92 | 17 (◎) | Good | 113 | 20 (○) | Good | Minor scratches |
| Ex. 6 | 95 | 15 (◎) | Good | 112 | 19 (◎) | Good | Good |
| Ex. 7 | 99 | 18 (◎) | Good | 115 | 20 (○) | Good | Good |
| Ex. 8 | 97 | 16 (◎) | Good | 113 | 17 (◎) | Good | Good |
| Ex. 9 | 100 | 18 (◎) | Good | 118 | 21 (○) | Good | Good |
| Ex. 10 | 93 | 15 (◎) | Good | 110 | 18 (◎) | Good | Good |
| Ex. 11 | 95 | 17 (◎) | Good | 114 | 19 (◎) | Good | Good |
| Ex. 12 | 98 | 16 (◎) | Good | 116 | 17 (◎) | Good | Good |
| Ex. 13 | 95 | 14 (◎) | Good | 113 | 18 (◎) | Good | Good |
| Ex. 14 | 99 | 19 (◎) | Good | 117 | 20 (○) | Good | Good |
| Ex. 15 | 90 | 10 (◎) | Good | 99 | 14 (◎) | Good | Minor scratches |
| Ex. 16 | 93 | 12 (◎) | Good | 104 | 17 (◎) | Good | Good |
| Ex. 17 | 95 | 13 (◎) | Good | 107 | 17 (◎) | Good | Good |
| Ex. 18 | 98 | 17 (◎) | Good | 110 | 18 (◎) | Good | Slightly large abrasion loss |
| Ex. 19 | 100 | 18 (◎) | Good | 114 | 20 (○) | Good | Slightly large abrasion loss |
| Ex. 20 | 90 | 12 (◎) | Good | 100 | 13 (◎) | Good | Good |
| Ex. 21 | 101 | 16 (◎) | Good | 115 | 18 (◎) | Good | Slightly large abrasion loss |
| Ex. 22 | 99 | 14 (◎) | Good | 112 | 20 (○) | Good | Slightly large abrasion loss, minor scratches |
| Ex. 23 | 103 | 18 (◎) | Good | 118 | 22 (○) | Good | Slightly large abrasion loss, minor scratches |
| Ex. 24 | 102 | 20 (○) | Good | 128 | 25 (○) | Good | Slightly large abrasion loss, minor scratches |
| Ex. 25 | 98 | 17 (◎) | Good | 110 | 19 (◎) | Good | Slightly large abrasion loss, minor scratches |
| Ex. 26 | 96 | 15 (◎) | Good | 110 | 17 (◎) | Good | Slightly large abrasion loss, minor scratches |
| Ex. 27 | 107 | 18 (◎) | Good | 124 | 23 (○) | Good | Slightly large abrasion loss, minor scratches |
| Ex. 28 | 110 | 20 (○) | Good | 130 | 27 (○) | Good | Slightly large abrasion loss, minor scratches |
| Ex. 29 | 105 | 18 (◎) | Good | 127 | 28 (○) | Good | Good |
| Ex. 30 | 98 | 13 (◎) | Good | 110 | 17 (◎) | Good | Good |
| Ex. 31 | 94 | 13 (◎) | Good | 105 | 14 (◎) | Good | Good |
| Ex. 32 | 96 | 11 (◎) | Good | 103 | 13 (◎) | Good | Good |
| Ex. 33 | 92 | 15 (◎) | Good | 107 | 16 (◎) | Good | Good |
| Ex. 34 | 99 | 16 (◎) | Good | 110 | 18 (◎) | Good | Good |
| Ex. 35 | 97 | 18 (◎) | Good | 115 | 19 (◎) | Good | Good |

TABLE 2-1-continued

| | At the beginning of running test | | | After 100,000 copies were produced | | | |
|---|---|---|---|---|---|---|---|
| | VL (−V) | Job-to-job variation of VL (V) | Image quality | VL (−V) | Job-to-job variation of VL (V) | Image quality | Mechanical durability |
| Ex. 36 | 100 | 14 (◎) | Good | 112 | 17 (◎) | Good | Good |
| Ex. 37 | 95 | 12 (◎) | Good | 107 | 16 (◎) | Good | Good |
| Ex. 38 | 94 | 13 (◎) | Good | 103 | 14 (◎) | Good | Good |
| Comp. Ex. 1 | 135 | 28 (○) | Good | 210 | 45 (X) | Blurred image | Good |
| Comp. Ex. 2 | 140 | 25 (○) | Good | 185 | 53 (X) | Blurred and low density image | ◎ |
| Comp. Ex. 3 | 165 | 28 (○) | Good | 210 | 45 (X) | Blurred and low density image | Slightly large abrasion loss, minor scratches |
| Comp. Ex. 4 | 130 | 20 (○) | Good | 160 | 36 (Δ) | Blurred and low density image | Slightly large abrasion loss, minor scratches |
| Comp. Ex. 5 | 145 | 27 (○) | Good | 180 | 36 (Δ) | Blurred and low density image | Good |
| Comp. Ex. 6 | 100 | 15 (◎) | Good | 120 | 35 (Δ) | Good | Large abrasion loss, many scratches |
| Comp. Ex. 7 | 200 | 60 (X) | Blurred and low density image | — | — | — | — |

TABLE 2-2

| | After 200,000 copies were produced | | |
|---|---|---|---|
| | VL (−V) | VL variation (V) | Image quality |
| Ex. 29 | 142 | 32 (○) | Image density slightly decreased |
| Ex. 30 | 134 | 27 (○) | Image density slightly decreased |
| Ex. 31 | 113 | 18 (◎) | Good |
| Ex. 32 | 117 | 17 (◎) | Good |
| Ex. 33 | 118 | 19 (◎) | Good |
| Ex. 34 | 125 | 25 (○) | Good |
| Ex. 35 | 127 | 27 (○) | Good |
| Ex. 36 | 130 | 23 (○) | Good |
| Ex. 37 | 112 | 17 (◎) | Good |
| Ex. 38 | 113 | 19 (◎) | Good |

It is clear from Tables 2-1 and 2-2 that the photoreceptors of Examples 1-28 maintained good characteristics even after the 100,000-copy running test, and good images could be produced without causing the low density image problem, the blurred image problem while maintaining small job-to-job potential variation. In addition, the photoreceptors of Examples 29-38 maintained good characteristics even after the 200,000-copy running test, and produced good images without causing the low density image problem and the blurred image problem while maintaining small job-to-job potential variation. Further, it can be understood from the tables that the mechanical durability is influenced by addition of a filler to the outermost layer, and the content of the crosslinked material in the outermost layer.

In contrast, the photoreceptors of Comparative Examples 1-3 could produce good images at the beginning of the running test, but produced images with deteriorated image qualities after the 100,000-copy running test. In addition, the comparative photoreceptors had very large job-to-job potential variation while. Further, the photoreceptors of Comparative Examples 4 and 5 could produce good images at the beginning of the running test, but produced seriously deteriorated images after the 100,000-copy running test. In addition, the job-to-job potential variation of the comparative photoreceptors was on a slightly unacceptable level. Furthermore, although the photoreceptor of Comparative Example 6 could produce good images at the beginning and end of the 100,000-copy running test, the photoreceptor had large abrasion loss, and there were many scratches on the surface of the photoreceptor. Furthermore, the photoreceptor of Comparative Example 7 had worst charge decaying property before the running test while producing images with deteriorated image qualities, and therefore the running test using the photoreceptor was not performed.

Additional modifications and variations of the present invention are possible in light of the above teachings. It is therefore to be understood that within the scope of the appended claims the invention may be practiced other than as specifically described herein.

What is claimed is:

1. A photoreceptor comprising:

an electroconductive substrate;

a photosensitive layer located overlying the electroconductive substrate; and a crosslinked outermost layer located overlying the photosensitive layer and including a crosslinked material and a carbazole compound having no crosslinkable group and having the following formula (1):

(1)

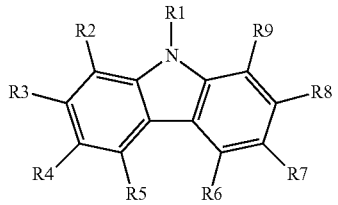

wherein each of R1 to R9 represents a hydrogen atom, a nitro group, a cyano group, a halogen atom, a hydroxyl group, a saturated aliphatic hydrocarbon group which optionally has a substituent, a substituted or unsubstituted aromatic hydrocarbon group, a substituted or unsubstituted alkoxyl group, a substituted or unsubstituted aryloxy group, an amino group, a substituted or unsubstituted dialkylamino group, or a substituted or unsubstituted diarylamino group, wherein each of combinations R3 and R4, R4 and R5, R6 and R7, and R7 and R8 optionally shares bond connectivity to form a ring.

2. The photoreceptor according to claim 1, wherein the carbazole compound has the following formula (2):

(2)

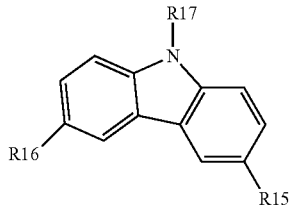

wherein each of R15 and R16 represents a hydrogen atom, a saturated aliphatic hydrocarbon group which has 1 to 4 carbon atoms and which optionally has a substituent, or a substituted or unsubstituted aromatic hydrocarbon group; and R17 represents a saturated aliphatic hydrocarbon group which has 1 to 4 carbon atoms and which optionally has a substituent, or a phenyl or biphenyl group which optionally has a substituent.

3. The photoreceptor according to claim 1, wherein the carbazole compound has the following formula (3):

(3)

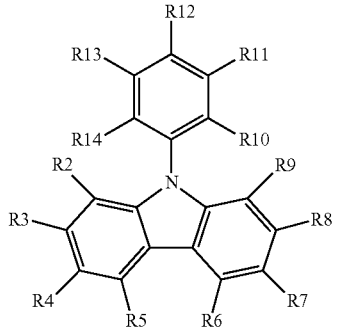

wherein each of R2 to R14 represents a hydrogen atom, a nitro group, a cyano group, a halogen atom, a hydroxyl group, a saturated aliphatic hydrocarbon group which optionally has a substituent, a substituted or unsubstituted aromatic hydrocarbon group, a substituted or unsubstituted alkoxyl group, a substituted or unsubstituted aryloxy group, an amino group, a substituted or unsubstituted dialkylamino group, or a substituted or unsubstituted diarylamino group, wherein each of combinations R3 and R4, R4 and R5, R6 and R7, R7 and R8, R11 and R12, and R12 and R13 optionally shares bond connectivity to form a ring.

4. The photoreceptor according to claim 1, wherein the carbazole compound has the following formula (4):

(4)

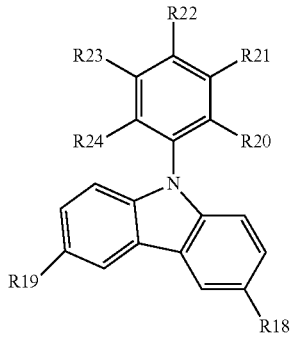

wherein each of R18 and R19 represents a hydrogen atom, a saturated aliphatic hydrocarbon group which has 1 to 4 carbon atoms and which optionally has a substituent, or a substituted or unsubstituted aromatic hydrocarbon group; each of R20, R21, R23 and R24 represents a hydrogen atom, or a saturated aliphatic hydrocarbon group which has 1 to 4 carbon atoms and which optionally has a substituent; and R22 represents a hydrogen atom, a saturated or unsaturated aliphatic hydrocarbon group which has 1 to 4 carbon atoms and which optionally has a substituent, or a substituted or unsubstituted aromatic hydrocarbon group.

5. The photoreceptor according to claim 1, wherein the carbazole compound has the following formula (5):

(5)

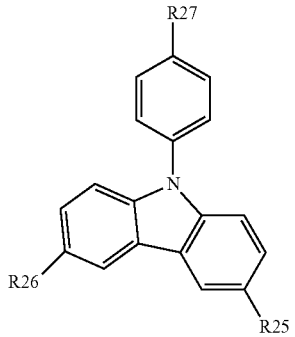

wherein each of R25 and R26 represents a hydrogen atom, a saturated or unsaturated aliphatic hydrocarbon group which has 1 to 4 carbon atoms and which optionally has a substituent, or a substituted or unsubstituted aromatic hydrocarbon group; and R27 represents a hydrogen atom, a saturated aliphatic hydrocarbon group which has 1 to 4 carbon atoms and which optionally has a substituent, or an aromatic hydrocarbon group optionally substituted with an aliphatic hydrocarbon group having 1 to 4 carbon atoms.

6. The photoreceptor according to claim 1, wherein the carbazole compound has the following formula (6):

(6)

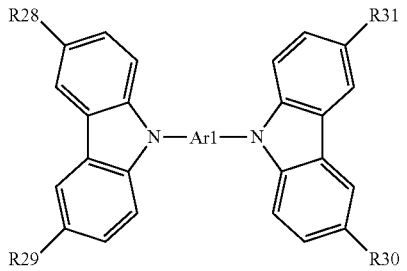

wherein Ar1 represents a phenylene group, a biphenylene group, or a saturated aliphatic hydrocarbon group having 1 to 4 carbon atoms; and each of R28, R29, R30 and R31 represents a hydrogen atom, a saturated aliphatic hydrocarbon group which has 1 to 4 carbon atoms and which optionally has a substituent, or a substituted or unsubstituted aromatic hydrocarbon group.

7. The photoreceptor according to claim 1, wherein the carbazole compound has the following formula (7):

(7)

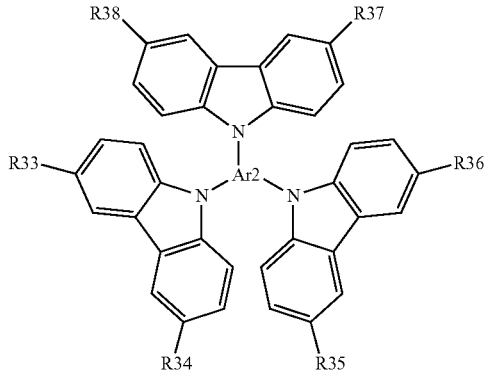

wherein Ar2 represents a phenylyne group, or a triphenyl amine group; and each of R33, R34, R35, R36, R37 and R38 represents a hydrogen atom, a saturated aliphatic hydrocarbon group which has 1 to 4 carbon atoms and which optionally has a substituent, or a substituted or unsubstituted aromatic hydrocarbon group.

8. The photoreceptor according to claim 1, wherein the crosslinked material in the crosslinked outermost layer includes a unit obtained from a radically polymerizable compound having not less than three functional groups and no charge transport structure.

9. The photoreceptor according to claim 1, wherein the crosslinked outermost layer further includes a particulate inorganic or organic material.

10. An image forming apparatus comprising:

the photoreceptor according to claim 1;

a charger to charge the photoreceptor;

an irradiator to irradiate the charged photoreceptor with light to form an electrostatic latent image thereon;

a developing device to develop the electrostatic latent image with a developer including a toner to form a toner image on the photoreceptor; and a transferring device to transfer the toner image onto a recording material.

11. A process cartridge comprising:

the photoreceptor according to claim 1;

at least one of a charger to charge a surface of the photoreceptor;

a developing device to develop an electrostatic latent image on the surface of the photoreceptor with a developer including a toner to form a toner image on the photoreceptor;

a transferring device to transfer the toner image onto a recording material;

a cleaner to clean the surface of the photoreceptor after transferring the toner image; and a discharger to decay residual charges remaining on the photoreceptor after transferring the toner image.

* * * * *